US010655278B2

(12) United States Patent
Jacob

(10) Patent No.: US 10,655,278 B2
(45) **Date of Patent: *May 19, 2020**

(54) MULTIPLE TIER ELEVATED LIGHT TRAIN

(71) Applicant: cTrain Corporation, Cambridge, MA (US)

(72) Inventor: Emil Jacob, Cambridge, MA (US)

(73) Assignee: cTrain Corporation, Lewes, DE (US)

( * ) Notice: Subject to any disclaimer, the term of this patent is extended or adjusted under 35 U.S.C. 154(b) by 370 days.

This patent is subject to a terminal disclaimer.

(21) Appl. No.: 15/231,722

(22) Filed: Aug. 8, 2016

(65) Prior Publication Data

US 2016/0347330 A1 Dec. 1, 2016

Related U.S. Application Data

(63) Continuation-in-part of application No. 14/737,677, filed on Jun. 12, 2015, now Pat. No. 9,809,933.

(60) Provisional application No. 62/202,162, filed on Aug. 6, 2015, provisional application No. 62/011,541, filed on Jun. 12, 2014.

(51) Int. Cl.

| | |
|---|---|
| ***B61B 1/02*** | (2006.01) |
| ***B61B 15/00*** | (2006.01) |
| ***E01B 26/00*** | (2006.01) |
| ***B61B 3/00*** | (2006.01) |
| ***B61B 5/02*** | (2006.01) |
| ***E01B 25/22*** | (2006.01) |
| ***E01B 25/26*** | (2006.01) |

(Continued)

(52) U.S. Cl.

CPC ..... *E01B 26/00* (2013.01); *B61B 1/02* (2013.01); *B61B 3/00* (2013.01); *B61B 3/02* (2013.01); *B61B 5/02* (2013.01); *B61B 15/00* (2013.01); *E01B 25/22* (2013.01); *E01B 25/24* (2013.01); *E01B 25/26* (2013.01)

(58) Field of Classification Search

CPC ..... E01B 25/04; E01B 25/26; E01B 25/22; E01B 25/00; E01B 25/08; E01B 25/305; B61B 5/00; B61B 3/00; B61B 15/00; B61B 13/04; B61B 1/02; B61B 13/00; B61B 5/02; B61B 1/00; Y02T 30/30

USPC ..... 104/123, 124, 94, 95, 119, 28, 30

See application file for complete search history.

(56) References Cited

U.S. PATENT DOCUMENTS 137,552 A * 4/1873 Hulbert ..... E01B 25/305 104/124

365,341 A * 6/1887 Hamilton ..... E01B 25/305 104/124

(Continued)

OTHER PUBLICATIONS

Parija Kavilznz, Sky Taxis are about to become a reality, CNN Money, http://money.cnn.com/2015/10/23/smallbusiness/skytran-air-taxis/, Oct. 23, 2015; last viewed Feb. 23, 2017.

(Continued)

*Primary Examiner* — Mark T Le

(57) ABSTRACT

A method for enabling elevated trains for travel both above as well as below a vertically-tiered pair of tracks by having wheels both in the upper and lower area of the train with the ability to switch from traveling on the upper tracks using lower wheels to traveling on the lower track using upper wheels, where the said method of switching between upper and lower tracks enables trains to be moved between multiple levels serving as passing loops as well as vertical depots.

5 Claims, 40 Drawing Sheets

(51) Int. Cl.
*E01B 25/24* (2006.01)
*B61B 3/02* (2006.01)

(56) References Cited

U.S. PATENT DOCUMENTS

| | | | | | |
|---|---|---|---|---|---|
| D52,163 | S | * | 7/1918 | Holstein | D11/119 |
| 3,590,743 | A | | 7/1971 | Larson | |
| 3,648,617 | A | | 3/1972 | Metzner | |
| 3,882,786 | A | * | 5/1975 | Woligrocki | B61B 5/00 104/118 |
| 4,580,380 | A | | 4/1986 | Ballard | |
| 5,253,589 | A | | 10/1993 | Kawanishi | |
| 5,456,183 | A | | 10/1995 | Geldbaugh | |
| 5,511,488 | A | * | 4/1996 | Powell | B60L 13/06 104/124 |
| 5,895,288 | A | * | 4/1999 | Nelson | H02G 3/0481 174/135 |
| 6,314,890 | B1 | | 11/2001 | Geldbaugh | |
| 9,809,933 | B2 | * | 11/2017 | Jacob | E01B 25/24 |
| 2005/0166785 | A1 | | 8/2005 | Schramek et al. | |
| 2008/0000192 | A1 | * | 1/2008 | McGlinch | E04H 12/2292 52/835 |
| 2009/0320713 | A1 | | 12/2009 | Amiri | |

OTHER PUBLICATIONS

Jpods.com website http://jpods.com; two pages submitted; last viewed Feb. 23, 2017.

Schneider, Jerry, Innovative Transportation Technologies, http://faculty.washington.edu/jbs/itrans/; last viewed Feb. 23, 2017.

* cited by examiner

MULTIPLE TIER ELEVATED LIGHT TRAIN

CROSS-REFERENCE TO RELATED APPLICATIONS

This patent application is a continuation-in-part of application Ser. No. 14/737,677 filed on Jun. 12, 2015 and claims the benefit of provisional application 62/202,162 filed Aug. 6, 2015, which are incorporated herein by reference.

TECHNICAL FIELD

The invention described herein relates to systems and methods of mass transit using elevated trains. More specifically, the inventions described herein include systems and methods and systems of elevated trains with multiple tiers of tracks and switching between levels.

BACKGROUND

Elevated trains have been used to transport personnel. Conventionally at least a pair of tracks are located generally parallel. In cities, it is not uncommon to find the pair of generally parallel tracks elevated above a road for motor vehicles or walkways for pedestrians. In suburbia and between cities it is not uncommon to find the tracks elevated above the median between the roads.

SUMMARY

It is recognized that elevated trains can provide a method of mass transit in a way that is cost effective and with minimal visual impact on the urban landscape. It is recognized that if the elevated trains could be tiered vertically in contrast to horizontally or parallel to the ground, than it results in lessening the visual impact. An elevated transport model is inexpensive to build and maintain, so as to be implemented on all major avenues to make it accessible within a few blocks of any business or residential area. The elevated train is fully automated and built from lightweight materials and powered by small electric motors which results in mass trains at a fraction of the cost when compared to buses or other existing modes of public transportation.

In certain embodiments, a transportation system includes a support structure, a lower track, and an upper track. The lower track has a pair of lower rails. The lower rails are supported by the support structure. The upper track has a pair of upper rails. The upper rails space above the lower rails. The upper rails are supported by the support structure. The system has a vehicle having an upper support structure with a plurality of upper wheels capable of riding on the lower track and a lower support structure with a plurality of lower wheels capable of riding on the upper track.

In certain embodiments, the transportation system has at least one station having a platform. The floor of the vehicle is higher than the platform wherein passengers are capable of entering and exiting the vehicle with less vertical movement than would be required to get up and sit down if the vehicle floor and station platform were at the same level.

In certain embodiments, the vehicle has a plurality of doors and a plurality of seats wherein there is at least one door for each two seats.

In certain embodiments, the vehicle has an interior with a ceiling and a pair of side walls and having a height and width adapted to accommodate two adjacent seated passengers per row. The vehicle is sized such that a passenger is capable of reaching the ceiling and at least one wall from the seated position. The reduced width and height of the vehicle help reduce the visual impact on the landscape as well as allow for lower weight than conventional trains thus reducing the costs of the support structures and the visual effect on the built urban environment, while providing maximum comfort via seated accommodations.

In certain embodiments, the vehicle has an interior with a ceiling and a pair of side walls and having a height and width adapted to accommodate one seated passenger per row. The vehicle is sized such that a passenger is capable of reaching the ceiling and the pair of side walls from the seated position.

In certain embodiments, the transportation system has at least one station having a platform. The station has a plurality of outer doors adapted to align with the doors on the vehicle. The station has an indication system associated with the outer doors for indicating the availability of seats on approaching vehicles. In certain embodiments, the indication system indicates available seats on vehicles beyond the first approaching vehicle. In certain embodiments, the vehicle has an input system associated with each seat.

In certain embodiments, the transportation system has a control system that records the passenger selected destination in order to provide information for passengers awaiting at the upcoming stops where to stand for the next open seat. In certain embodiments, the transportation system has a signaling arrangement identifying vacant seats and the indication system is enabled to receive signals that show awaiting passengers in the upcoming stations which doors will have open seats. In certain embodiments, the system displays to awaiting passengers how many vehicles it will take to get an open seat at a particular door.

In certain embodiments, the rails have an oval shape wherein the major axis is vertical and upon which the wheel rides. In certain embodiments, the oval rail has an outer layer and internal honeycomb structure.

In certain embodiments, the supporting structure has a hook shape that provides support of the lower tracks therein allows free movement of the upper wheels and the upper body of the vehicle.

In certain embodiments, the transportation system includes another track wherein the track intersects by the crossing of rails and having a transition section. The wheels of the vehicle move from being supported by the tracks over inner wheel area to support of the outer sides of the wheel area by a pair of support grooves over a distance cut in the track therein allowing for the crossing of another track.

In certain embodiments, the transportation system includes a plurality of gates movable between a closed position and an open position to allow sections holding the upper wheels of the vehicle to pass across intersecting tracks.

In certain embodiments of a transportation system, the transportation system includes a support structure, a first lower track, a second lower track, a first upper track, and a second upper track. The first lower track has a pair of lower rails; the lower rails are supported by the support structure. The first upper track has a pair of upper rails; the upper rails are spaced above the lower rails. The upper rails are supported by the support structure. The second lower track has a pair of lower rails; the lower rails are supported by the support structure. The lower rails of the second lower track intersect the first lower track by the crossing of rails and having a transition section adapted for the wheel of the vehicle moving from being supported by the tracks over the inner wheel area to supporting of the outer sides of the wheel area by a transition section wherein the wheel of the vehicle moves from being supported by the tracks over the inner wheel area to supporting of the outer sides of the wheel area by a pair of support grooves over a distance cut in the track therein allowing for the crossing of the another track. The second upper track has a pair of upper rails. The upper rails are spaced above the lower rails. The upper rails supported by the support structure, the upper rails of the second upper track intersect the first upper track by the crossing of rails and having a transition section adapted for the wheel of the vehicle moving from being supported by the tracks over the inner wheel area to support of the outer sides of the wheel area by a transition section wherein the wheel of the vehicle moves from being supported by the tracks over the inner wheel area to support of the outer sides of the wheel area by a pair of support grooves over a distance cut in the track therein allowing for the crossing of the another track.

In certain embodiments, the supporting structure has a hook shape that provides support of the lower tracks therein allowing free movement of the upper wheels and the upper body of the vehicle.

In certain embodiments, the transportation system includes a plurality of gates movable between a closed position and an open position to allow sections holding the upper wheels of the vehicle to pass across intersecting tracks.

In certain embodiment of a transportation system, the transportation system includes a support structure, a lower track, and an upper track. The lower track has a pair of lower rails; the lower rails are supported by the support structure. The upper track has a pair of upper rails. The upper rails are spaced above the lower rails. The upper rails are supported by the support structure. The system has a plurality of tracks adapted to guide a vehicle having an upper support structure with a plurality of upper wheels capable of riding on the lower track and a lower support structure with a plurality of lower wheels capable of riding on the upper track is on the upper track, the plurality of tracks guiding the vehicle between riding with the upper wheels on a lower track and the lower wheels on an upper track.

In a certain embodiment of a transportation system, the plurality of tracks adapted to guide the vehicle include an auxiliary track having a first portion spaced from the upper track such when a vehicle having an upper support structure with a plurality of upper wheels capable of riding on the lower track and a lower support structure with a plurality of lower wheels capable of riding on the upper track is on the upper track, the upper wheels align with a first portion of the auxiliary track. A second auxiliary track is spaced from the lower track such when the upper wheels are capable of riding on the lower track, the lower wheels align with the second auxiliary track. A mobile track is movable between an upper position and lower position and is connected to the first auxiliary track wherein the movable track in the lower position the mobile track guides a vehicle using the upper wheels onto the secondary auxiliary track which receives the lower wheels and the movable track in the upper position wherein the vehicle is capable of riding on the secondary auxiliary track without engaging the mobile track.

In certain embodiments, the system includes additional structures with upper and lower tracks each with a pair of rails. The tracks are spaced above the first structure with upper and lower track, and plurality of tracks adapted to allow vehicles to move between a plurality of levels therein defining a depot to store vehicles.

In certain embodiments of a transportation system, the system has a support structure, a lower track, and an upper track. The lower track is supported by the support structure. The upper track is spaced above the lower track and supported by the support structure. The system has at least one vehicle having an upper support structure with a plurality of upper movement mechanism capable of riding on the lower track and a lower support structure with a plurality of lower movement mechanism capable of riding on the upper track. The system has an auxiliary track, a second auxiliary track, and a mobile track. The auxiliary track has a first portion spaced from the upper track such when a vehicle having an upper support structure with a plurality of upper movement mechanism capable of riding on the lower track and a lower support structure with a plurality of lower movement mechanism capable of riding on the upper track is on the upper track, the upper movement mechanism align with a first portion of the auxiliary track. The second auxiliary track spaced from the lower track such when the upper movement mechanism capable of riding on the lower track, the lower movement mechanism align with the second auxiliary track. The mobile track is movable between an upper position and lower position and is connected to the first auxiliary track wherein with the movable track in the lower position the mobile track guides a vehicle using the upper movement mechanism onto the secondary auxiliary track which receives the lower movement mechanism and the movable track in the upper position wherein the vehicle a capable of riding on the secondary auxiliary track without engaging the mobile track.

In certain embodiments, the support structure is a plurality of structure arches. In an embodiment, the rails of each of the tracks are located generally equidistant from the apex of the arches therein allowing for minimal thickness of the rails while maximizing support.

In certain embodiments, the arches are spaced a specific distance d that is less than the length l of the vehicle therein the weight of the train is borne by the arches rather than the rails.

In certain embodiments, the vehicle has at least one horizontal safety wheel for engaging a rail of the track for stabilizing against derailments.

In an embodiment, a transportation system for a vehicle having upper wheels and lower wheels includes a support structure, a first lower track and a second lower track. The first lower track has a pair of lower rails for engaging the upper wheels of the vehicle. The lower rails are supported by the support structure.

The second lower track has a pair of lower rails. The lower rails are supported by the support structure. The second lower track intersects the first lower track. The first lower track and the second lower track each have a gap such that the rails are each spaced apart from each other. A crossing support track has a first pair of rails underlying the first lower track and has a second pair of rails underlying the second lower track. The second pair of rails of the crossing support track intersects the first pair of rails and is adapted to engage the lower wheels of the vehicle when the vehicle passes through the gap of the lower track.

In certain embodiments, the transportation the crossing support track having a transition section adapted for the wheel of the vehicle moving from being supported by the tracks over the inner wheel area to being supported by the outer sides of the wheel area by a transition section wherein the wheel of the vehicle moves from being supported by the tracks over the inner wheel area to support of the outer sides of the wheel area by a pair of support grooves over a distance cut in the track therein allowing for the crossing of the another track.

In certain embodiments, the horizontal safety wheel has a smaller diameter than the support grooves.

In certain embodiments, the supporting structure has a hook shape that provides support of the lower tracks therein allowing free movement of the upper wheels and the upper body of the vehicle.

In certain embodiments, the system has a first upper track having a pair of upper rails. The upper rails are spaced above the lower rails. The upper rails are supported by the support structure. A second upper track has a pair of upper rails. The upper rails are spaced above the lower rails. The upper rails are supported by the support structure. The upper rails of the second upper track intersect the first upper track by the crossing of rails and has a transition section adapted for the wheel of the vehicle moving from being supported by the tracks over the inner wheel area to support of the outer sides of the wheel area by a transition section wherein the wheel of the vehicle moves from being supported by the tracks over the inner wheel area to support of the outer sides of the wheel area by a pair of support grooves over a distance cut in the track therein allowing for the crossing of the another track.

In certain embodiments, the system has a plurality of gates that are movable between a closed position and an open position to allow the support sections of the vehicle holding the upper wheels of the vehicle to pass by the intersecting tracks.

In certain embodiments, a transportation system for a vehicle having upper wheels and lower wheels includes a support structure, a first lower track, and a second lower track. The first lower track has a pair of lower rails for engaging the upper wheels of the vehicle. The lower rails are supported by the support structure. The second lower track has a pair of lower rails. The lower rails are supported by the support structure. The second lower track intersects the first lower track. The first lower track and the second lower track each have a gap such that the rails are each spaced apart from each other. The system has a crossing support track having a first pair of rails underlying the first lower track and has a second pair of rails underlying the second lower track. The second pair of rails of the crossing support track intersect the first pair of rails and are adapted to engage the lower wheels of the vehicle when the vehicle passes through the gap of the lower track.

In certain embodiments, a transportation system includes a support structure, a lower track, and an upper track. The lower track has a pair of lower rails. The lower rails are supported by the support structure. The upper track has a pair of upper rails. The upper rails are spaced above the lower rails. The upper rails are supported by the support structure. The vehicle has an upper support structure with a plurality of upper wheels capable of riding on the lower track and a lower support structure with a plurality of lower wheels capable of riding on the upper track. The system has at least one station having a platform, wherein the floor of the vehicle is higher than the platform wherein passengers are capable of entering and exiting the vehicle with less vertical movement than would be required to get up and sit down if the vehicle floor and station platform were at the same level. The vehicle has an area having a floor planar with the platform of the station for facilitating access by a wheeled vehicle.

In certain embodiments, the wheeled vehicle includes a wheel chair and a stroller. In a certain embodiment, the vehicle has a plurality of doors and a plurality of seats wherein there is at least one door for each two seats.

In certain embodiments, the vehicle has a pair of opposing seats including a seatback portion and a seating portion. The seating portion is adapted to move between a horizontal position for regular seats and a vertical position adapted to have an area having a floor planar with the platform of the station for facilitating access by a wheeled vehicle.

In certain embodiments of the transportation system, the support structure includes a plurality of structure arches. The system has at least one station having a platform. A plurality of support members are secured to the arch providing structural support for the station.

In certain embodiments, at least one arch provides support directly to the station without any connecting members.

In certain embodiments, the transportation system includes a plurality of trusses including a plurality of trusses extending between the upper tracks and the lower tracks for distributing the vertical loads.

In certain embodiments, the transportation system includes at least one horizontal truss system for horizontal stability. In certain embodiments, the horizontal truss system includes one member at a lower level sufficiently above the lower tracks to provide clearance for lower trains.

In certain embodiments, the transportation system includes foliage for covering the arches as a way to increase ambience and introduce a more natural environment into the city landscape.

In certain embodiments, the stations are adaptable for various lengths of trains by varying the length of the platform.

It is to be understood that the features of the various embodiments described herein are not mutually exclusive and may exist in various combinations and permutations.

BRIEF DESCRIPTION OF THE SEVERAL VIEWS OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A transportation system has a pair of tracks each having a pair of rails. One set of the tracks is a lower level track and accepts a vehicle that rides below the track. The second set of the track is an upper level track and accepts a vehicle that rides above the track. The vehicle has wheels both on the upper portion of the vehicle and wheels on the lower portion. The vehicle is shorter and lighter than conventional trains including subways.

Figure 1:
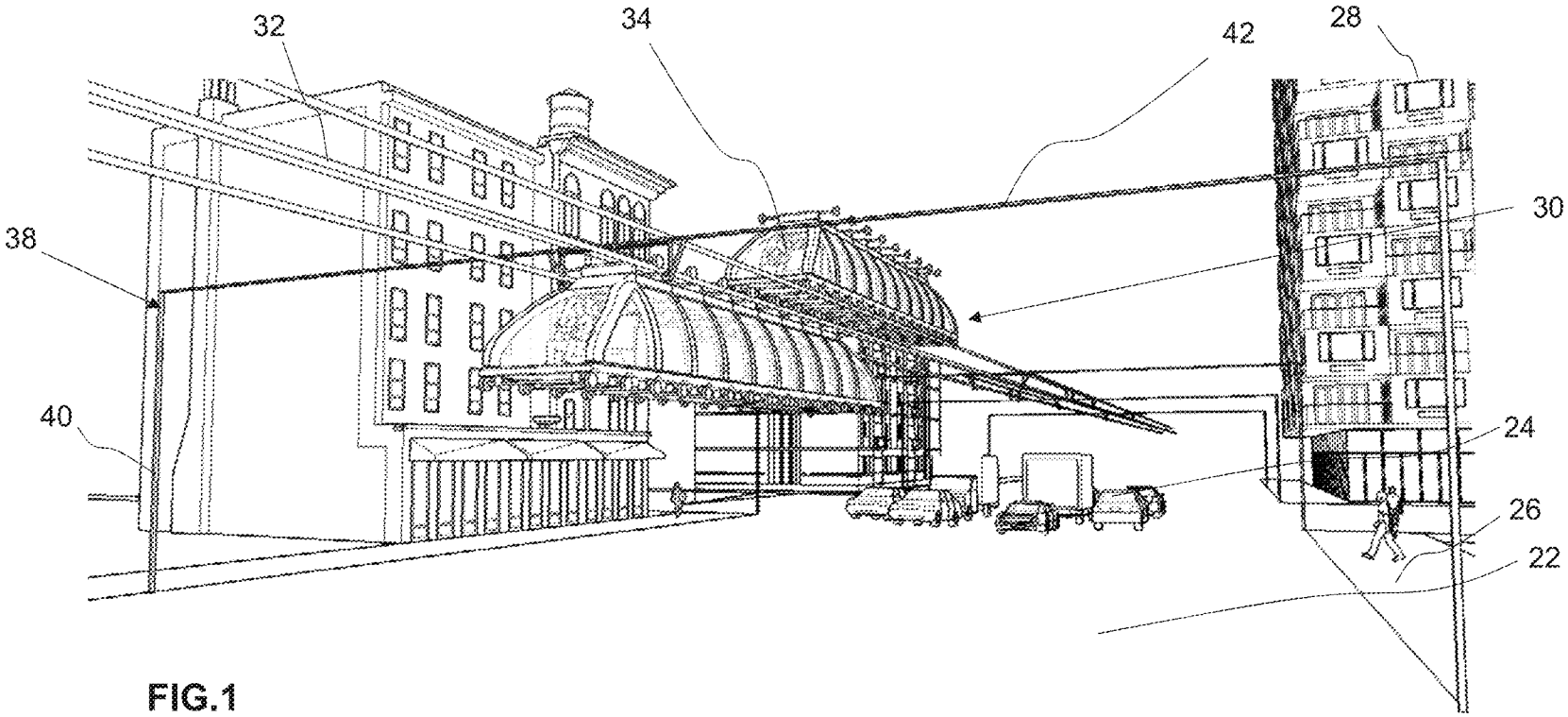
FIG. 1 is an perspective view of a multi-tier transportation 1 system according to the invention above the road.

Referring to FIG. 1, a perspective view of a multi-tier transportation system 30 above a road 20 is shown. The multi-tier transportation system 30 has a pair of tracks 32 upon which a vehicle 34 can ride. The pair of tracks 32 are supported by a support structure (system) 38 including a plurality of vertical supports 40 that position a plurality of horizontal supports 42 above the ground 22. In the view of FIG. 1, the ground 22 contains the road with vehicular traffic 24 such as cars, bus, and trucks. The ground 22 can also include sidewalks 26 for pedestrians and buildings 28.

Figure 2:
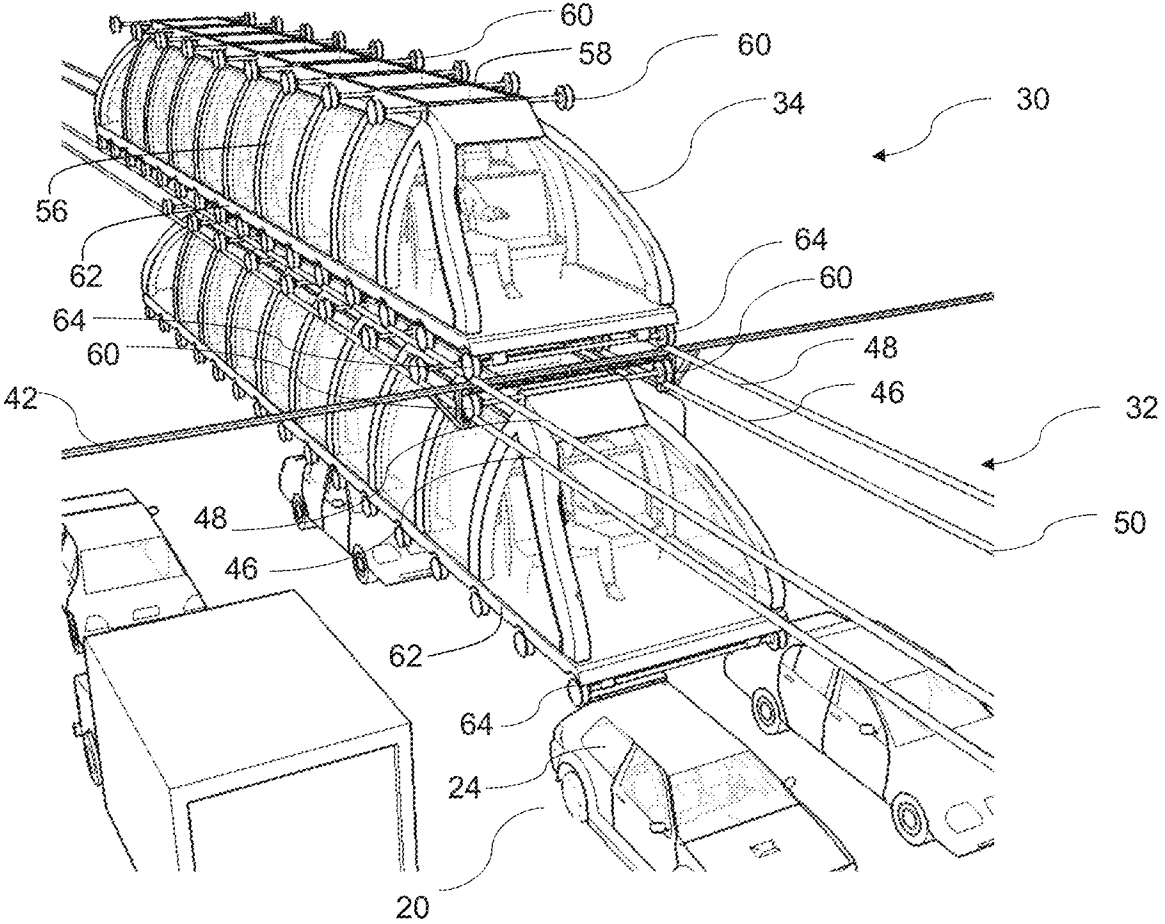
FIG. 2 is a perspective view of the multi-tier transportation system above a two lane road.

Referring to FIG. 2, a perspective view of the multi-tier transportation system 30 above a two lane road 20 is shown. The road 20 shows several vehicles 24 that underlie the pair of tracks 32. The pair of tracks 32 includes a lower track 46 and an upper track 48. Each track 38 and 40 has a pair of rails 50 that run parallel to each other. The multi-tier transportation system 30 has at least one vehicle 34. In FIG. 2 a pair of vehicles 34 is shown. The vehicles 34 could be referred to as light rail cars. Each light rail car 34 has a body 56, an upper support structure 58 with a plurality of upper wheels 60 and a lower support structure 62 with a plurality of lower wheels 64. The lower support structure 62 with the lower wheels 64 allows the light rail car 34 to travel on the upper track 48. The upper support structure 58 with the upper wheels 60 allows the light rail car 34 to travel on the lower track 46.

A horizontal support 42 of the support structure 38 is shown in the FIG. One of the goals of the transportation system 30 is to minimize the visual impact on the urban landscape as well as to build trains that are as light weight as possible and take up as little space as possible.

Figure 3:
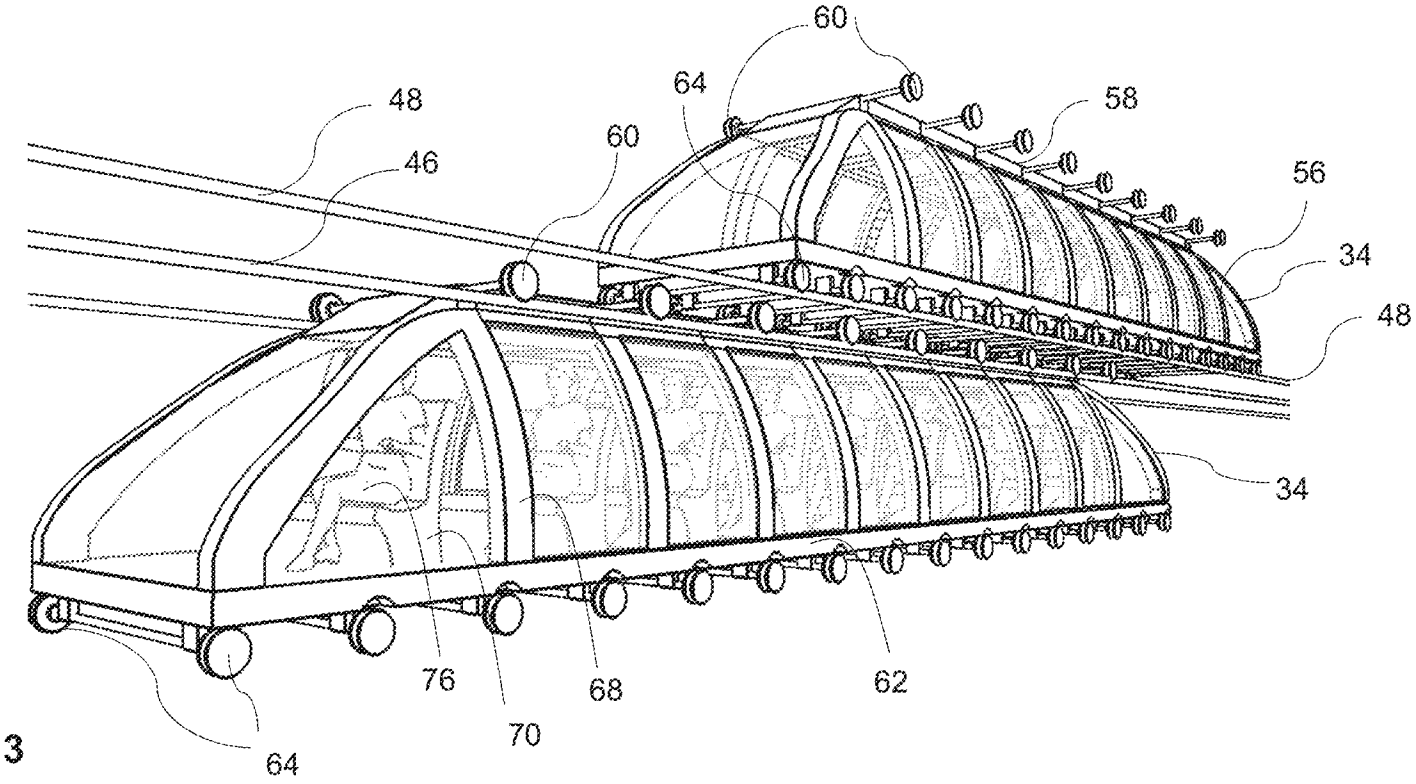
FIG. 3 is a perspective view of a vehicle on the upper rail and a second vehicle on the lower rail.

Referring to FIG. 3, a perspective view of a vehicle 34 on the upper track 48 and a second vehicle 34 on the lower track 46 is shown. The upper track 48 and the lower track 46 each have a pair of rails 50. The pair of rails for a track run parallel to each other and generally one of the rails 50 of the upper track 48 is located above the one of the rails 50 of the lower track. For the purpose of this patent, the rail 50 is the physical item that the wheels of the vehicle 34 rolls upon. A pair of rails 50 form a track 32. While the rails 50 of the upper track and the lower track 46 are identical in this embodiment, how the rail 50 interacts with the horizontal supports 42 of the support structure 38 and the vehicle 34 is different.

The light rail car 34 has the body 56, the upper support structure 58, and the lower support structure 62. The body has a plurality of beams or pillars 68 that extend between the upper support structure 58 and the lower support structure 62. The pillars 68 transfer the load of the light rail car 34 between the support structures 58 and 62. The lower support structure 62 with the lower wheels 64 allows the light rail car 34 to travel on the upper track 48; the pillars 68 support the weight of the upper support structure 58 and upper wheels 60. The upper support structure 58 with the upper wheels 60 allows the light rail car 34 to travel on the lower track 46; the pillars 68 support the weight of the lower support structure 62 and lower wheels 64 and the weight of seats 70, the doors 72, the windows 74, and the passengers 76.

Figure 4B:
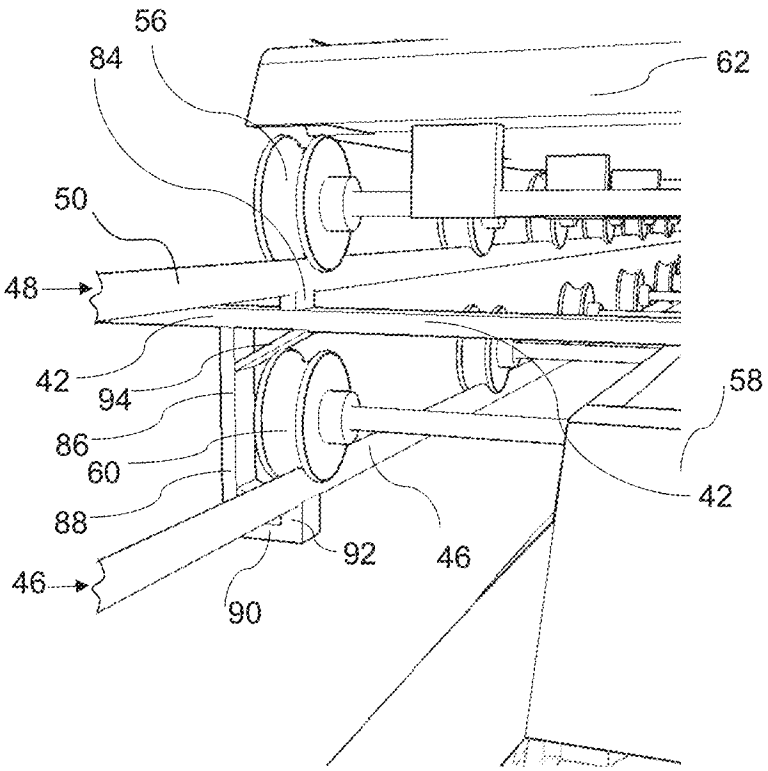
FIG. 4B is a different side perspective view of a rail of the upper track and a rail of the lower track and a portion of a pair of vehicles.
Figure 4A:
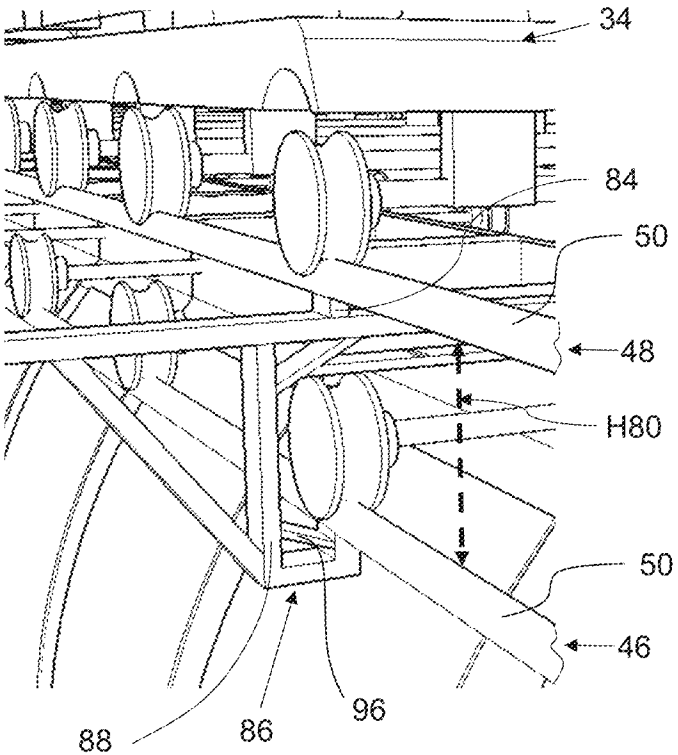
FIG. 4A is a side perspective view of a rail of the upper track and a rail of the lower track and a portion of a pair of vehicles.

Referring to FIG. 4A, a side perspective view of the rail 50 of the upper track 48 and the rail 50 of the lower track 46 and portion of vehicles 34 is shown. The distance between the rail 50 of the upper track 48 and the rail 50 of the lower track is shown as a height h, 80. The height h provides sufficient clearance so that a wheel, the upper wheel 60 is capable of operating on the rail 50 of the lower track 46 without interfering with the rail 50 of the upper track 48. The horizontal support 42 of the support structure 38 supports the upper tracks 48 and the lower tracks 46. The upper track 48 is supported a vertical support extension 84. The vertical support extensions 84 in an embodiment are approximately 2 inches height for the primary purpose of the lower wheels 64 not engaging the horizontal supports 42. The horizontal supports 42 and therefore the vertical support extensions 84 in an embodiment are located approximately 20 feet apart.

The rail 50 of the lower track 46 is supported by a hook-shaped extension 86 which supports the lower track 46 from below. The hook-shaped extension 86 has a generally vertical part 88 followed by a horizontal section 90 and a second vertical part 92 on which the lower track 46 is supported.

Referring to FIG. 4B, a different side perspective view of the rail 50 of the upper track 48 and the rail 50 of the lower track 46 and portion of vehicles 34 is shown. The rail 50 of the lower track 46 is supported by the hook-shaped extension 86 which supports the lower track 46 from below. The hook-shaped extension 86 has a generally vertical part 88 that is also supported by an angle arm 94 that also secured to the horizontal support 42. The height h is such that the upper wheel 60 is capable of operating on the rail 50 of the lower track 46 without interference. The hook-shaped extension 86 has a second angle arm 96 to support the second vertical part 92.

Figure 4C:
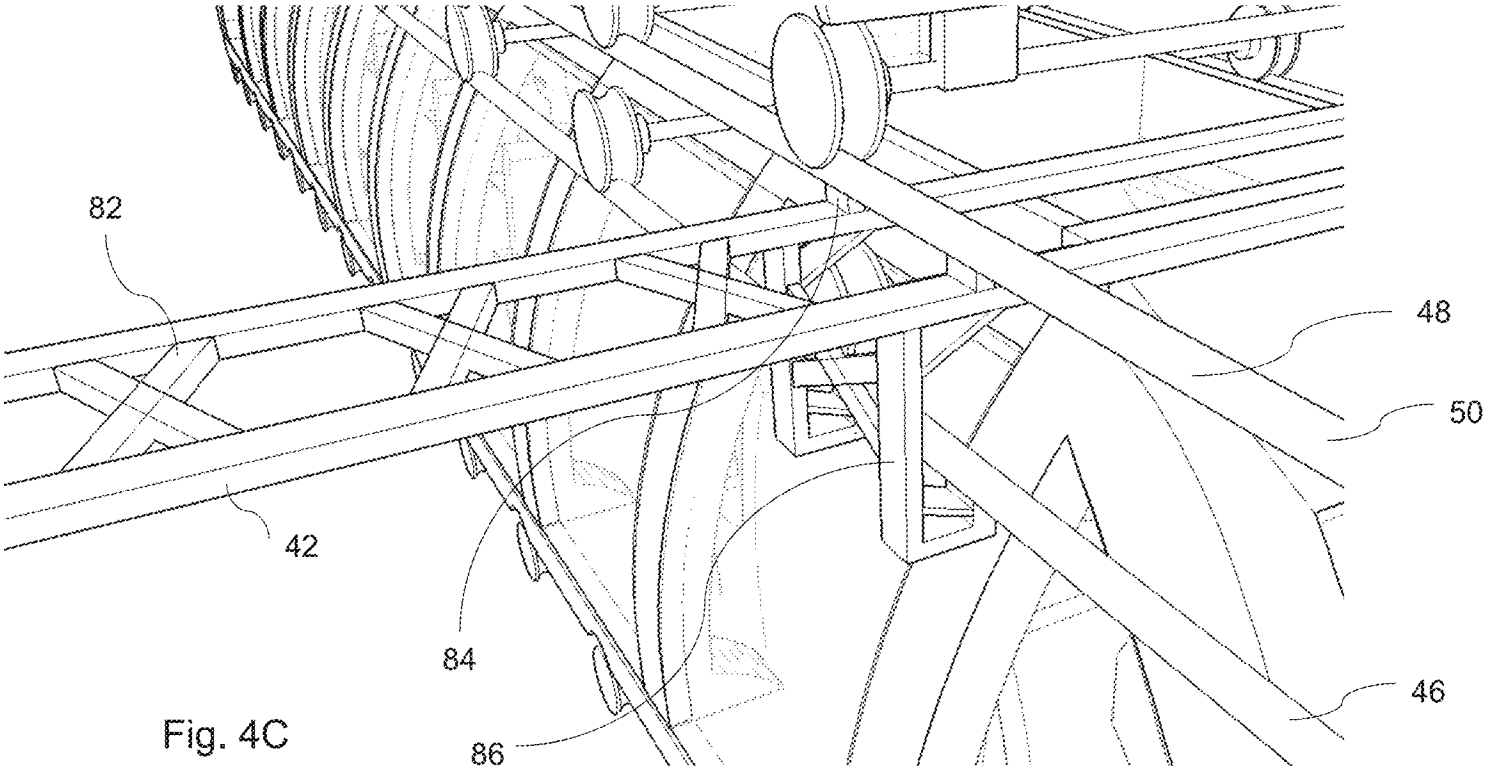
FIG. 4C is a perspective view of an alternative horizontal support of the support structure.

Referring to FIG. 4C, is a perspective view of an alternative horizontal support of the support structure is shown. The support structure 38 has a grouped pair of horizontal supports 42 in close proximity to each other. A series of cross supports 82 extend between the horizontal supports 42 to stiffen the support structure 38. It is recognized that the spacing can be more sparse. It is recognized that spacing is dependent on several factors including material and structural designs, as well as the number of grouped support structures 38, including factors such as the distance between the two grouped support structures 38. These factors will influence the minimum distance required to the next single or grouped structural support 38. It is contemplated that the pair of horizontal supports 42 will be spaced every 30 or 40 feet, and can be as much as 100 feet depending on the factors described.

Figure 5A:
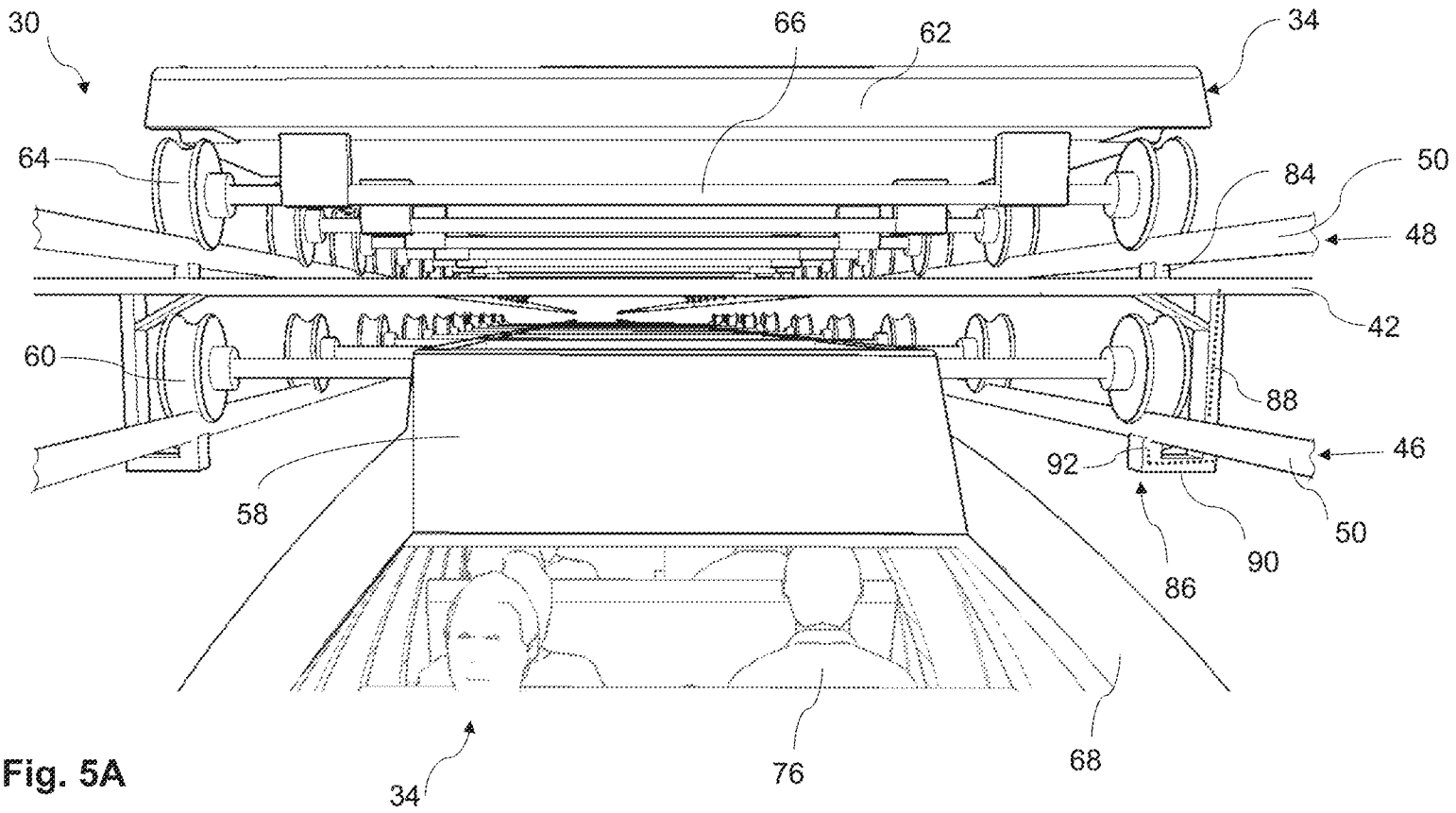
FIG. 5A is front perspective view of a rail of the upper track and a rail of the lower track and a portion of a pair of vehicles.

Referring to FIG. 5A, a front perspective view of the rails 50 of the upper track 48 and the rails 50 of the lower track 46 and portion of a pair of vehicles 34 are shown. With the vehicle 34 capable of riding on rails 50 both above or below the vehicle 34, the transportation system 30 can minimize on additional structure and the overall height of both the upper track 48 and the lower track 46 is not much more in height than the radius of the wheels 60 or 64. In the FIG., the lower support structure 62 of the vehicle 34 on the upper track 48 is shown. The lower wheels 64 rest on the rails 50 of the upper track 48. In contrast to conventional train wheels 64, the wheels have a pair flanges forming a "u" shaped groove that receives the rail 50. The vehicle 34 has a plurality of axles 66 which transfer the load from the wheels 64 to the lower support structure 62 and the vehicle 34.

While not shown in FIG. 5A, it is contemplated that the vehicles 34 will be powered by electric motors directly connected to the wheels or the axle. The power would be received by a catenary wire system. It is contemplated that in certain embodiments, the catenary wire system can be located above and below the horizontal supports 42 so that the vehicles 34 on the upper track 48 receive power from below and the vehicles on the lower track 46 receive power from above (i.e., power is received in proximity to the wheels that are interacting with the track 32.)

The upper support structure 58 of the vehicle 34 on the lower track 46 is shown. The upper wheels 60 rest on the rails 50 of the lower track 46. The vehicle 34 hangs from the upper wheels 60 via a plurality of axles 66 which transfer the load from the wheels 60 to the upper support structure 58 and the vehicle 34. The hook-shaped extension 86 for supporting the rail 50 of the lower track 46 from below is also shown. The hook-shaped extension 86 has a generally vertical part 88 that is also supported by an angle arm 94 that also secured to the horizontal support 42. The height h is such that the upper wheel 60 is capable of operating on the rail 50 of the lower track 46 without interference. The hook-shaped extension 86 has a second angle arm 96 to support the second vertical part 92.

Figure 5B:
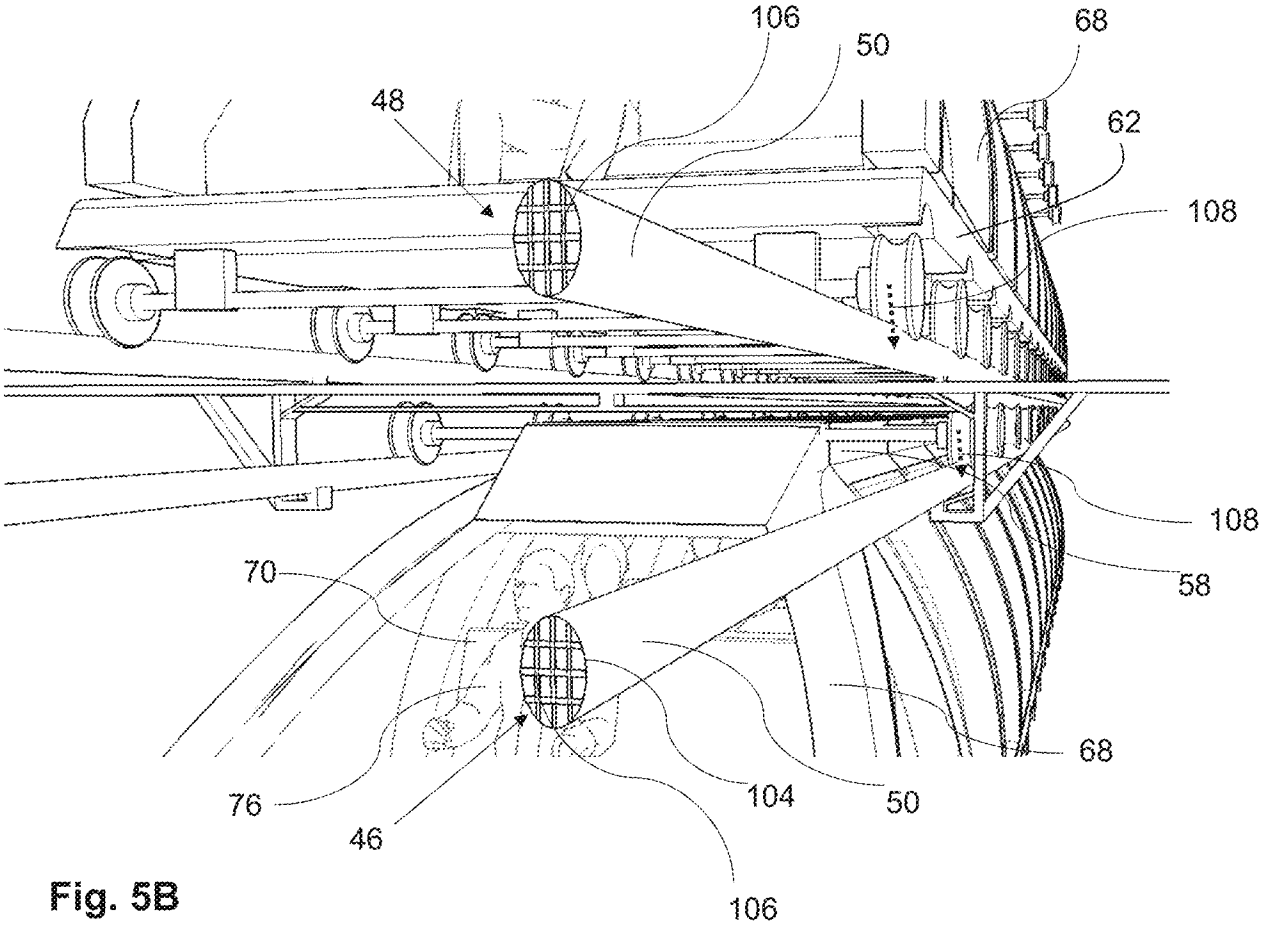
FIG. 5B is a side perspective view of a rail of the upper track and a rail of the lower track and a portion of a pair of vehicles.

Referring to FIG. 5B, a side perspective view of the rails 50 of the upper track 48 and the rails 50 of the lower track 46 and portion of a pair of vehicles 34 is shown. The rails 50 are an oval shape 102 and formed of an outer layer 104 and a plurality of support rods or honeycomb construction 106 located inside the oval shape 102 to support the outer layer 104. The vertically oval tracks 102 are formed to create resistance from vertical pressure P, 108 exerted by the wheels 60 and 64 on the rails 50 of the tracks 32. The support rods or honeycomb construction 106 provides for maximum resistance with minimal weight, minimal thickness as well as optimal shock absorption.

In addition, the passengers 76 seated on the seats 70 are seen in the vehicle 34 hanging from the lower track 46. The pillars 68 transfer the load from the lower support structure 62 to the upper support structure 58. The pillars 68 in the vehicles 34 are similar to pillars in other vehicles such as cars which are integral to the vehicle 34.

It is recognized that the support structure may vary from embodiment to embodiment. The support structure 38 in FIG. 5B is a slightly different configuration than that shown in FIG. 5A.

The transportation system 30 in addition to having the tracks 32 such that a vehicle 34 can ride on the upper track 48 that is just above a lower track 46, that allows for a rail system with minimum visual impact has other features that allow for efficient transportation of passengers. In contrast to conventional trains that are at least 10 feet in height and approximately generally 11 feet in height for subway cars and 13 feet for commuter rail, the vehicle 34 is designed to be no more than the height of an SUV in order to: minimize visual impact on the urban landscape; minimize weight; to be designed as to provide only seating options for all passengers; and easy access between standing on the platform and seating.

For example, in one embodiment, it is contemplated that the vehicle has a length of 320 to 400 inches, a width of 48 inches, and a height of 66 inches.

Figure 5C:
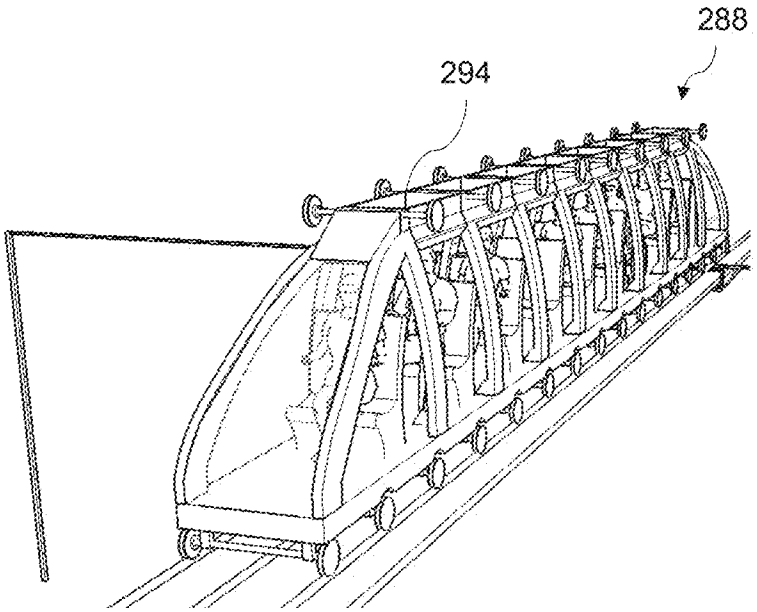
FIG. 5C is a side perspective view of an alternative rail system.

Referring to FIG. 5C, a side perspective view of an alternative rail system 288 is shown. In this alternative embodiment for narrower streets or lower density areas, the system 288 has tracks, an upper track 290 and a lower track 292, where the rails 50 are closer and each row in the vehicle has a single seat.

For example in one embodiment, it is contemplated that the vehicle has a length of 320 to 400 inches, a width of 36 inches, and a height of 66 inches.

Figure 6A:
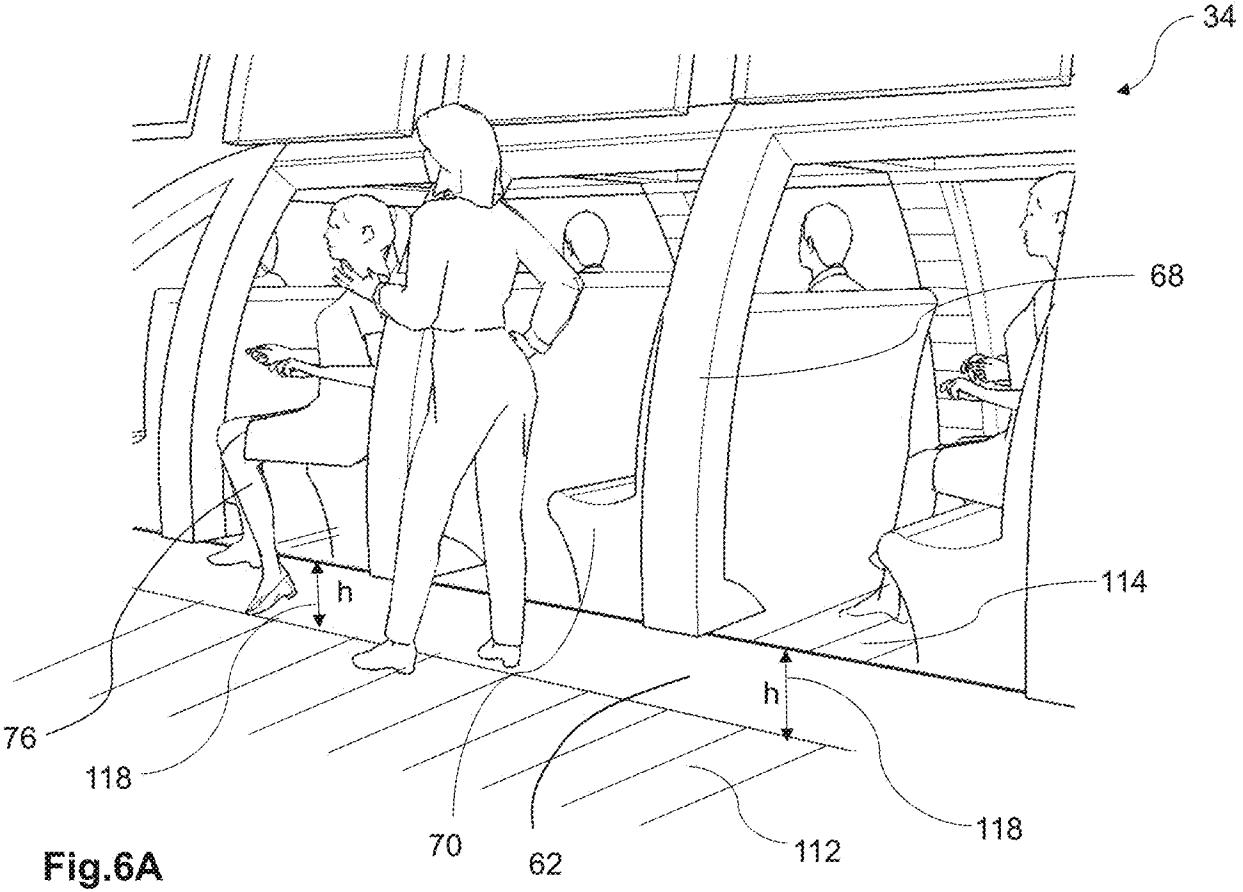
FIG. 6A is a perspective view of a vehicle, a light rail car, at a station platform.
Figure 6B:
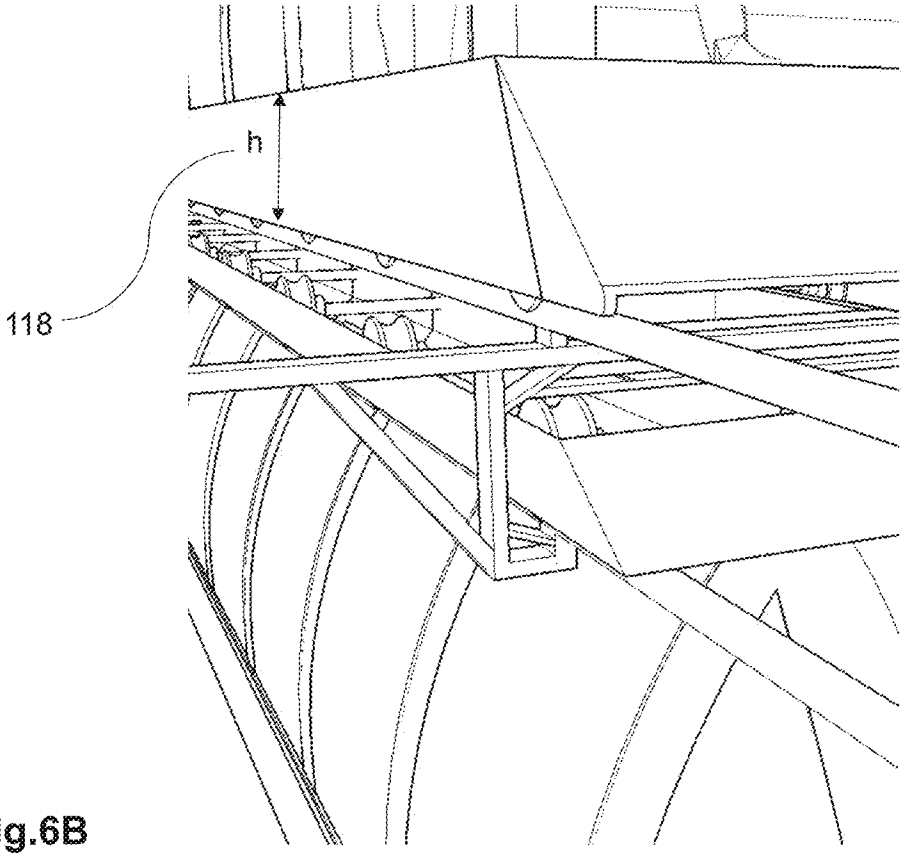
FIG. 6B is a perspective view of a vehicle showing an apron covering the wheels.

Referring to FIG. 6A, a perspective view of a vehicle, a light rail car 34, at a station platform 112 is shown. The transportation system 30 has a plurality of station platforms 112 in which passengers 76 can board and exit the vehicle 34. The support structure, such as the lower support structure 62 in part forms an apron 120 that covers the wheels 64 as seen in FIG. 6B. The height 118 shown in FIG. 6A is the majority of the apron 120 height. This height represented by arrow "h" between the platform of the station and the floor of the train, allows for easy entry and exit in the same way as when accessing an SUV.

Figure 6C:
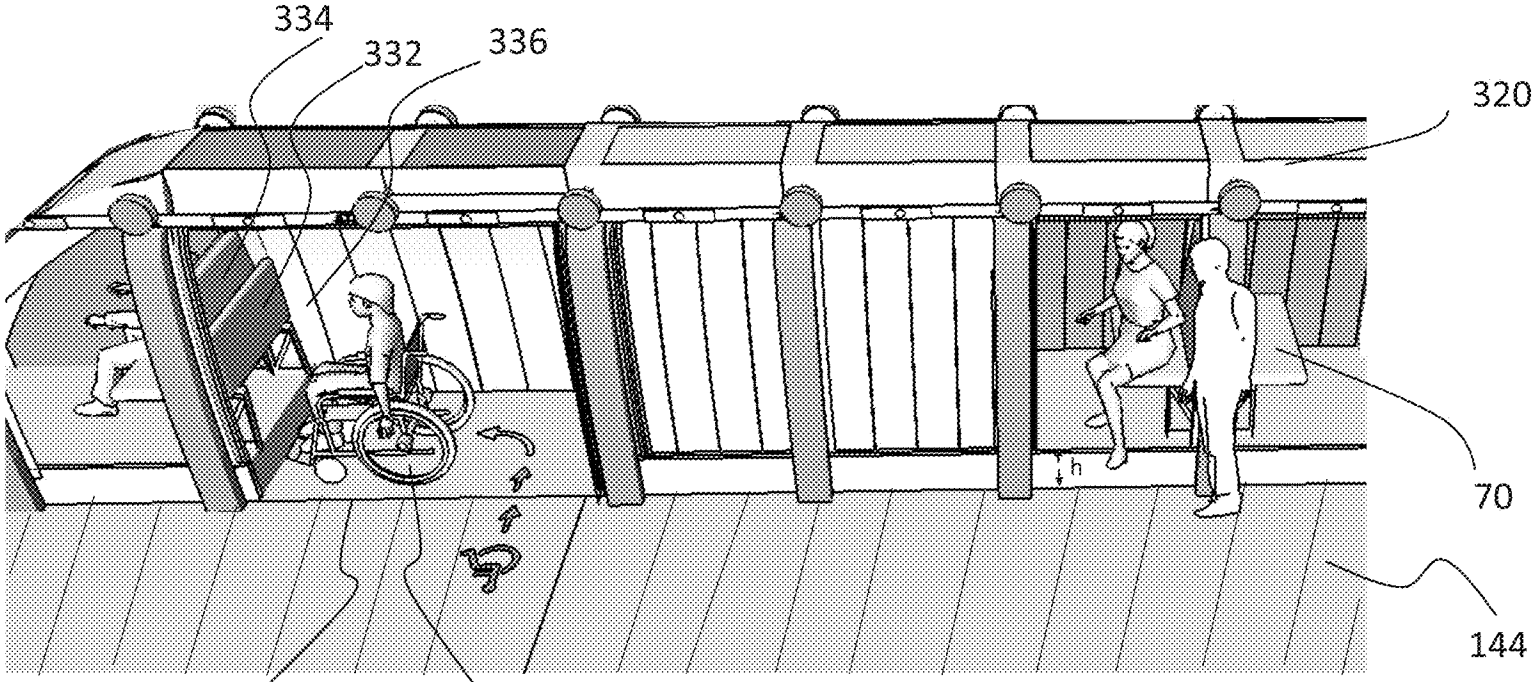
FIG. 6C is a perspective view of a vehicle showing a wheel chair accessible section.

Referring to FIG. 6C, a perspective view of an alternative vehicle, a light rail car 320, at a station platform 112 is shown. In contrast to the light rail car 34 that has a height differential shown, the alternative light rail car 320 has a section 322 where the floor 114 of the car 322 and the platform 112 of the station are at the same level in order to allow access for a wheeled vehicle 328 such as a wheel chair 330, a stroller, or a bicycle access. It is recognized that certain passengers such as with a cane, may opt for this section 322 to avoid lifting her leg.

This same level section has an opening that is generally double a standard opening. The section has a pair of doors 72 that slide in segments into the pillar 68 open to access the space. The section has a pair of seats 332 each including a seatback portion 334 and a seating portion 336. The seating portion 336 is movable between a horizontal position for regular seating and a vertical position to provide space for the wheeled vehicle 328 such the wheel chair 330. The section 322 does not have lower wheels 64 in order to allow the section 322 to be lower.

Figure 6D:
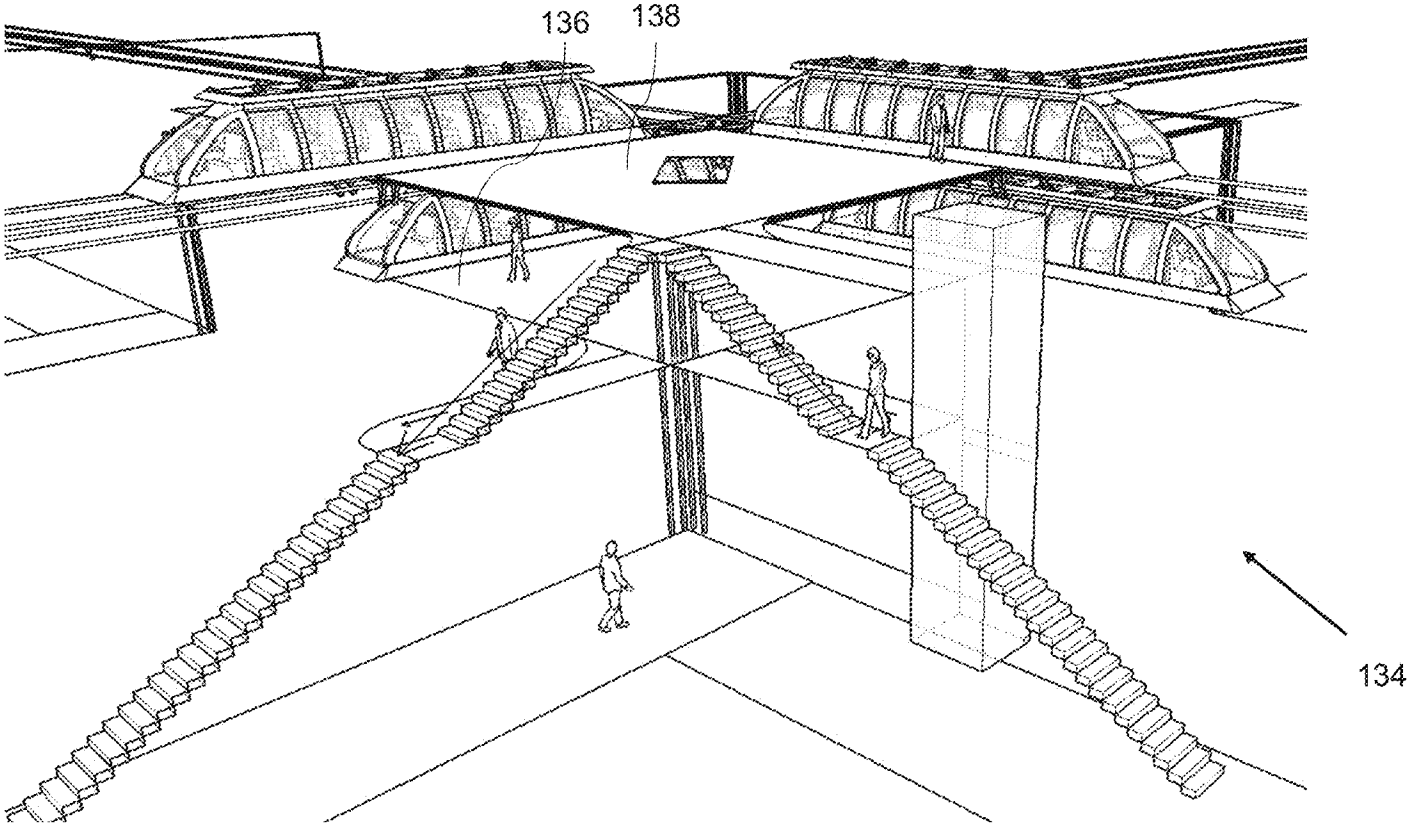
FIG. 6D is a perspective view of a station.

Referring to FIG. 6D, a perspective schematic view of a station 134 is shown. The station platform 136 for the lower track 46 and the station platform 138 for upper track 48 can be seen. The station 134 is shown for crossing tracks 34 which will be explained in more detail with respect to FIGS. 17A-19B. FIG. 6D like the remaining figures are a schematic representation missing many parts to enable easy view of the items discussed.

In the embodiment shown, the station platform 112 is on one side of the track 32. The passenger 76 on the other side of the vehicle 34 will have to exit through the vehicle, such as done in many amusement park rides. There are many benefits to this method. However it is recognized that others may decide to have platforms on each side to speed loading and unloading of vehicles 34. The opening of doors on both sides however may add to confusion as to who gets a seat.

The vehicle, the light rail car, 34 is shown with the lower support structure 62 and the upper support structure 58. The pillars 68 extend between the support structures 58 and 62 to transfer the loads and in certain situations act as door pillar. The vehicle 34, as indicated above, is of a height where the passengers 76 do not stand but rather sit on seats 70. The lower support structure also defines a vehicle or train floor 114. The doors 72 are shown in an open position; in this embodiment the doors 72 swing upward to grant access to the interior 116 of the vehicle 34. It is contemplated that in certain embodiment that is beneficial to have the doors slide sideways to open.

The rails 50 upon which the vehicle, the light rail car 34, rides are positioned relative to the station platform 112 such that the train floor 114 is at a level higher than the station platform 112. The difference in height h 118 allows the passengers 76 to enter and exit the vehicle 34 with less vertical movement than would be required to get up and sit down if the train floor 114 and station platform 112 were at the same level. FIG. 6A shows the passenger 76 stepping down to exit the vehicle 34 with the left foot, in the same way as when a passenger enters or exits an SUV. This feature allows passengers to exit or enter the seat more quickly and comfortably. In an embodiment, the height h 118 is designed to be in the range of 6 to 10 inches and preferably 8 inches.

Figure 7:
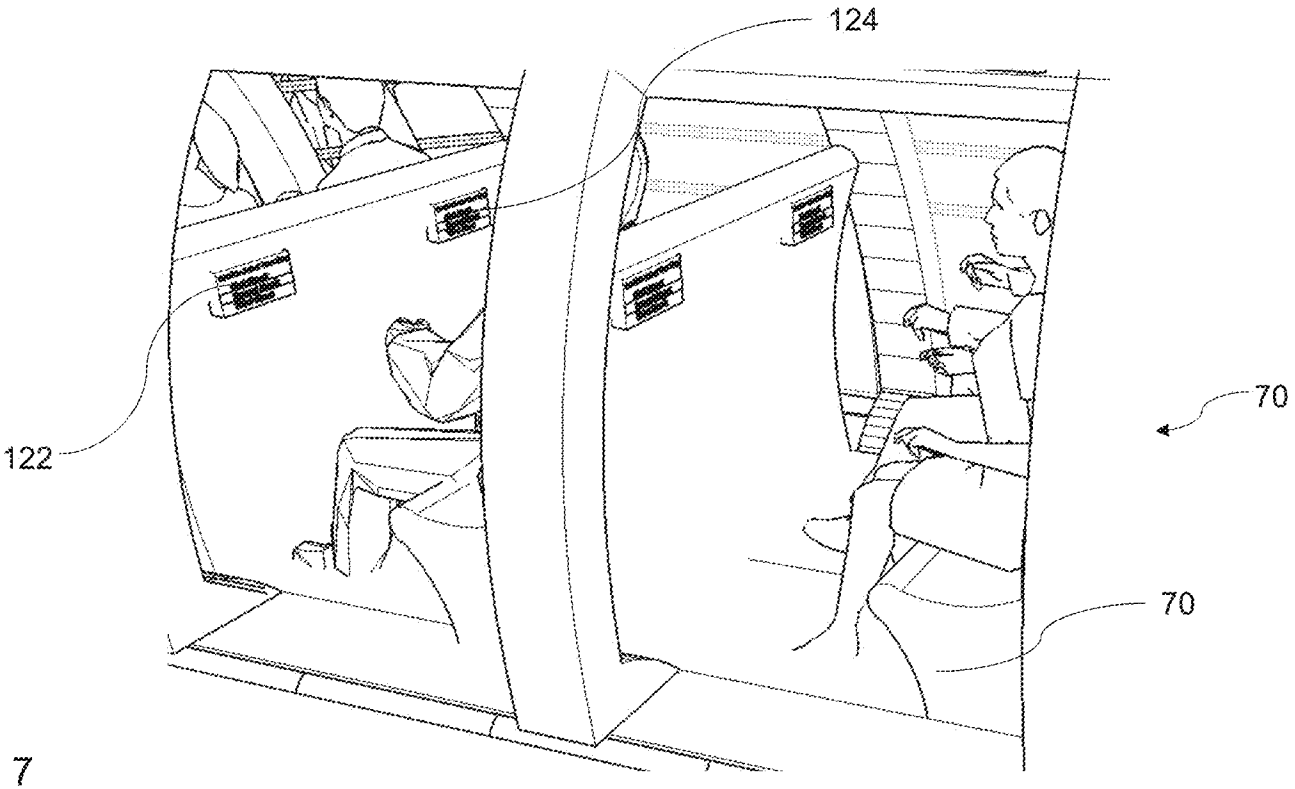
FIG. 7 is a perspective view of a portion of the vehicle showing a couple rows of seats.

Referring to FIG. 7, a perspective view of a portion of the vehicle 34 showing a couple rows of seats 70 is shown. The FIG shows several passengers 76 in several seats 70. The vehicle 34 has an input system 122 such as a digital screen 124 for passengers 76 to select their destination stop. The digital screen 124, where the passengers 76 need to scroll to select their destination stop, can be designed to provide either an incentive or an encouragement, such as a beeping light, to ensure that passengers 76 select their destination stop, as a courtesy to awaiting passengers 76. This feature, together with a technology that detects empty seats, such as technology used in passenger vehicles to detect a passenger in the front passenger seat, alerts passengers 76 at the upcoming stops, through the use of a light signal, where to stand for an open seat 70 in the incoming train.

Figure 8:
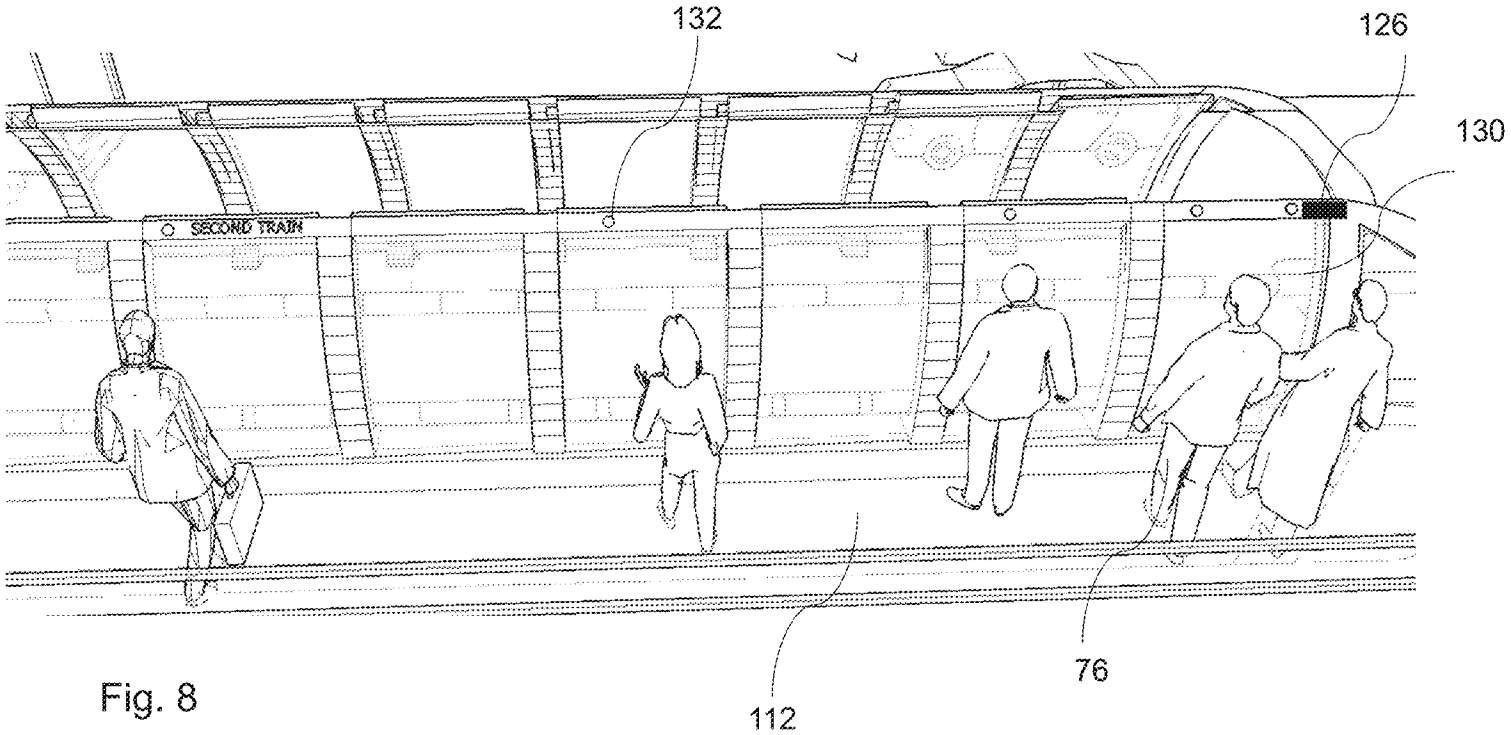
FIG. 8 is a side perspective view of a station platform with a plurality of passengers awaiting a vehicle.

Referring to FIG. 8, a side perspective view of a station platform 112 with a plurality of passengers 76 awaiting a vehicle, light rail car 34 is shown. The transportation system 30 has a wall 128 with a plurality of doors 130 at the station platform 112 to limit access to the tracks 32 when the vehicle 34 is not at the station platform 112. The transportation system 30 has an indication system 132 with a plurality of lights 132, that can provide an indication in sequential order of incoming trains where a seat will be available. The FIG. shows passengers 76 waiting at the outer door 130 of a double set of doors on the platform 112 for the incoming light rail car 34; the inner door 72 of the double set of doors is located on the light rail car 34 upon arrival. Above the outer door 130 lights 132 indicate where an open seat 70 will be available in the incoming train 34. If the open seat will be available in the train following the incoming train, there will be an indication labeled as SECOND TRAIN, as shown in FIG. (which can also be THIRD TRAIN, or FOURTH or more).

If the vehicle 34 is full, and no passengers 76 selected to exit at the next stop as their destination, the automated driver will skip that stop. The transportation system 30 has a control system 126 that can have software algorithms designed with further sophistication, i.e. if no passengers are getting on, or off at the next stop the train will skip that stop. It is recognized that the connection between components such as control system can be various methods including wire and wireless.

With the door opening on one side, since there are only two adjacent seats, passengers will just have to slide over to make room for the passenger that is coming in, and conversely step out to let the inner passenger get out. This method is quicker than conventional train and subway systems where typically passengers tend to slow down the process by clustering at the doors trying to get in and out at the same time and can often take a minute or more versus the proposed arrangement which would take 10-20 seconds.

As with most transportation systems 30, the system needs to move vehicles from tracks to tracks 32 to allow the vehicles 34 to move in the other direction. In addition, vehicles 32 need to be stored and queued. In conventional systems, there are switches between tracks that are generally located on the same plane, whether on the ground, subterranean, or above the ground. With respect to storage or queuing the vehicles, generally a large footprint on the ground or subterranean is required.

Figure 9A:
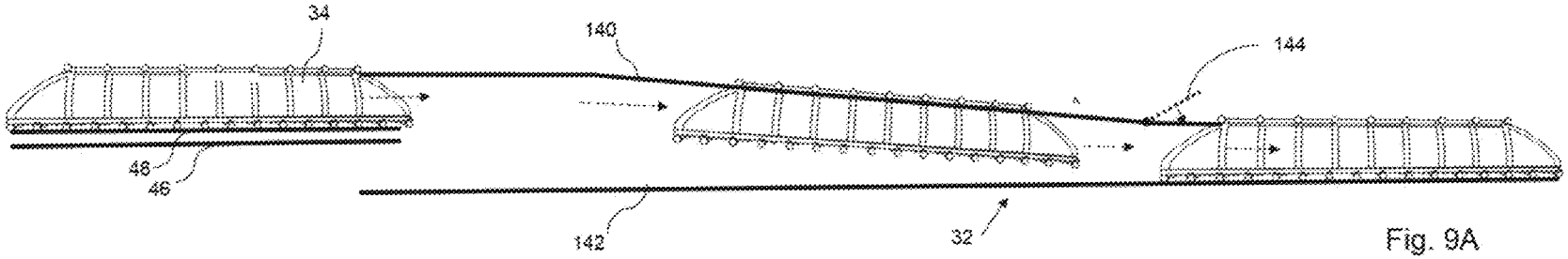
FIG. 9A is a side schematic of the first portion of a vehicle moving from an upper track to a lower track.
Figure 9B:
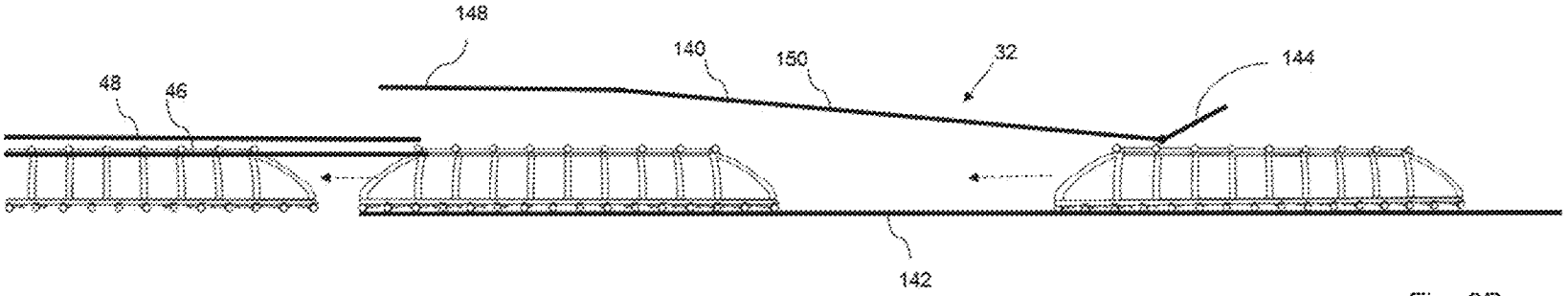
FIG. 9B is a side schematic view of the second portion of a vehicle moving from an upper track to a lower track.

Referring to FIG. 9A, a side schematic of the first portion of a vehicle moving from the upper track 48 to the lower track 46 is shown. When reaching the end of the line, the light rail car 34 can switch from traveling on the rails 50 of the upper track 48 to the opposite direction on the lower track 46. The movement is explained using six positions of which the first three are shown in FIG. 9A. Positions 4 through 6 are show in FIG. 9B. In the $1^{st}$ position the train is shown arriving on the upper track 48 and after completing the switch is departing on the lower tracks 46.

The transportation system 30 has several additional tracks 32 used to move vehicles 34. The transportation system includes a first auxiliary track 140, a second auxiliary track 142 and a mobile track 144. The first auxiliary track 140 has a first portion 148 that is parallel with the upper track 48 and is spaced from the upper track 48 such that the upper wheels 60 are received by the first auxiliary track 140 while the vehicle 34 is still riding on the upper track 48. The first auxiliary track 140 has a second portion 150 that is an incline that slopes downward to the mobile track 144 which will be explained in further detail below. The second auxiliary track 142 is parallel with the lower track 46 and spaced from the lower track 46 such that when the lower wheels 64 are on the second auxiliary track 142, the upper wheels 60 are aligned with the lower track 46.

Figure 10A:
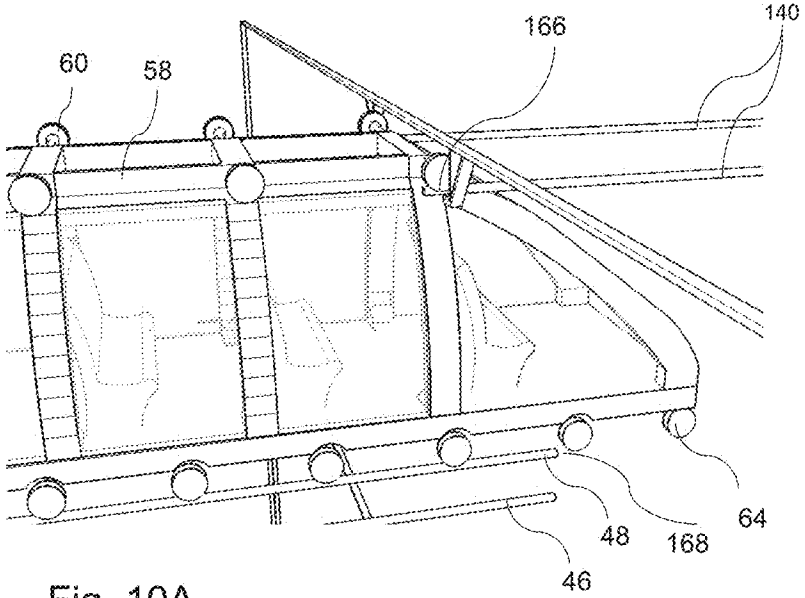
FIG. 10A is a side perspective view of a vehicle moving from an upper track to an auxiliary track.

Referring to FIG. 10A, a side perspective view of a vehicle 34 moving from the upper track 48 to the first auxiliary track 140 is shown. In the $1^{st}$ position 152, the vehicle 34 is shown arriving on the upper track 48 where the lower wheels 64 are on the rails 50 of the upper track 48. In order to perform the switch, the vehicle 34 moves onto the first auxiliary track 140 with the upper wheels 60 starting at the beginning point 166 of the first auxiliary track 140.

Figure 10B:
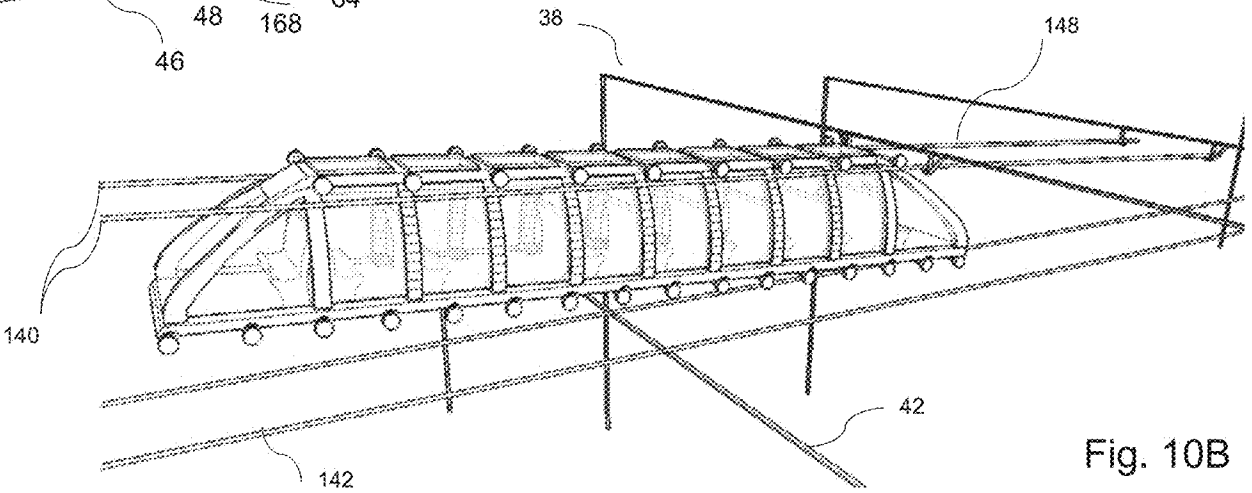
FIG. 10B is a side perspective view of a vehicle moving along the auxiliary track towards a second auxiliary track.

Referring to FIG. 10B, a side perspective view of a vehicle moving along the auxiliary track towards a second auxiliary track is shown. The vehicle 34 moves along the first auxiliary track 140 until the entire vehicle 34 is beyond the terminus 168 of the upper track 48. The vehicle 34 continues on the first auxiliary track 140.

Figure 11:
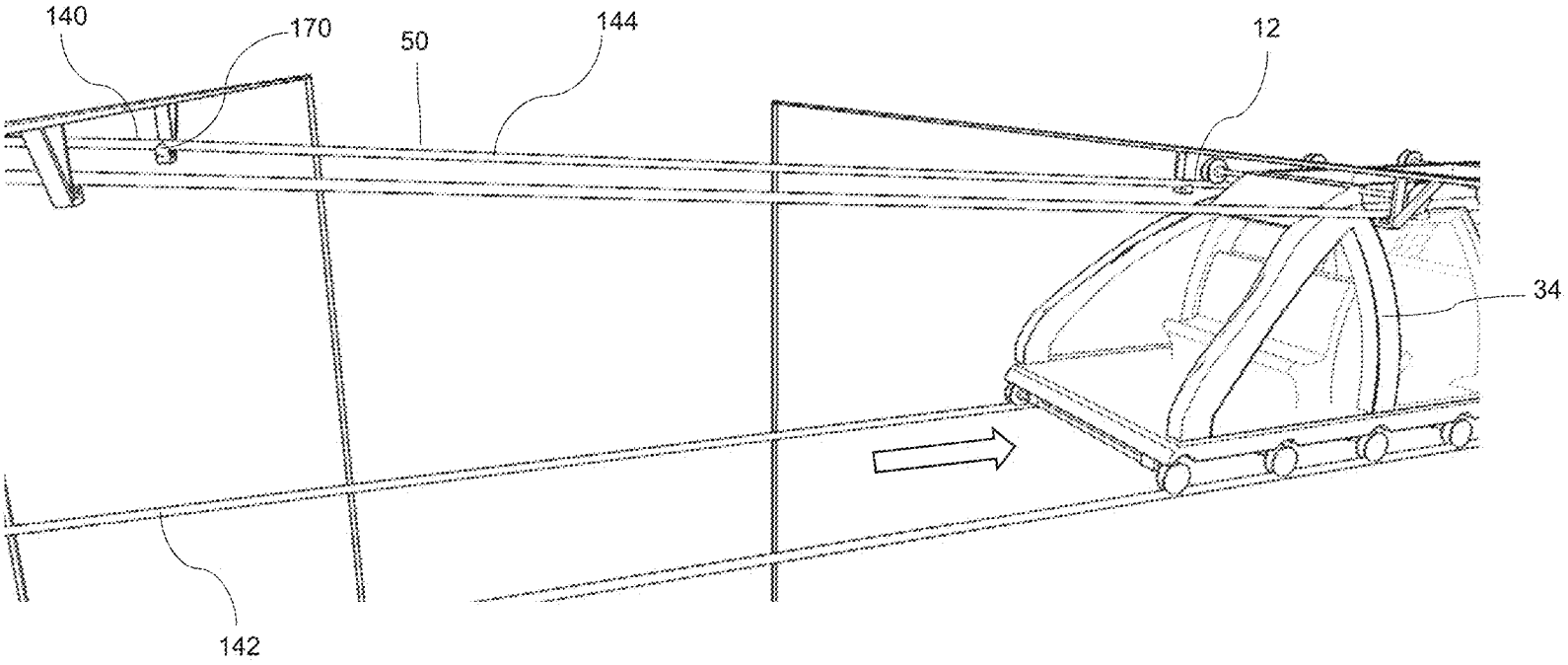
FIG. 11 is a side perspective view of a vehicle moving from a mobile track to the second auxiliary track.

Referring to FIG. 11, a side perspective view of a vehicle moving from the mobile track 144 to the second auxiliary track 142 is shown. The mobile track 144 moves between an up, raised, position and a lowered position shown in FIG. 11 about a pivot point 170. In the lowered position, when the vehicle 34 reaches a terminus point 172 of the mobile track 144, the lower wheels 64 engage the second auxiliary track 142. The vehicle 34 continues along the second auxiliary track 142 until the vehicle 34 completely clears the mobile track 144.

Figure 12A:
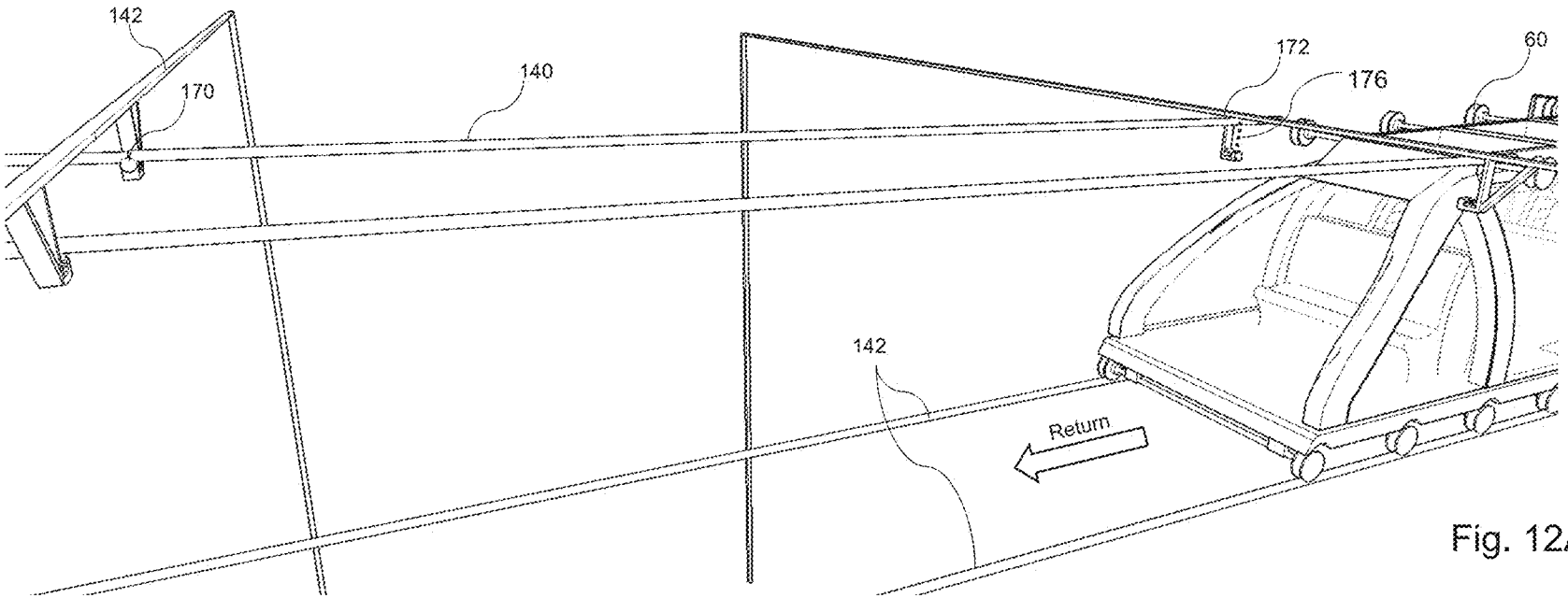
FIG. 12A is a second side perspective view of a vehicle moving from a mobile track to the second auxiliary track.
Figure 12B:
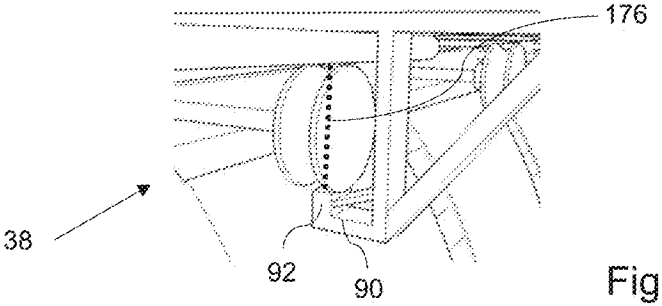
FIG. 12B is an enlarged view of the interaction of the hook-shaped extension and the mobile track.

Referring to FIG. 12A, a second side perspective view of a vehicle moving from the mobile track 144 to the second auxiliary track 142 is shown. Once the upper wheels 60 move away from the terminus point 172 of the mobile track 144, the pair of rails 50 of the mobile tracks 144 move up as shown in FIG. 12B. With the mobile track 144 up in the up, raised, position a clearance 176 is created for the vehicle 34 as seen in FIGS. 12A and 12B; the vehicle 34 is able to move in the opposite direction without having the upper wheels 60 latching onto the mobile track 144 but instead continuing on the second auxiliary track 142 as represented by the $4^{th}$ position. The support structure 38 has a hook-shaped extension 86 that is held by a horizontal support 42, as seen in FIG. 12A, to support the terminus point 172 of the mobile track 144 as seen in FIG. 11.

Figure 12C:
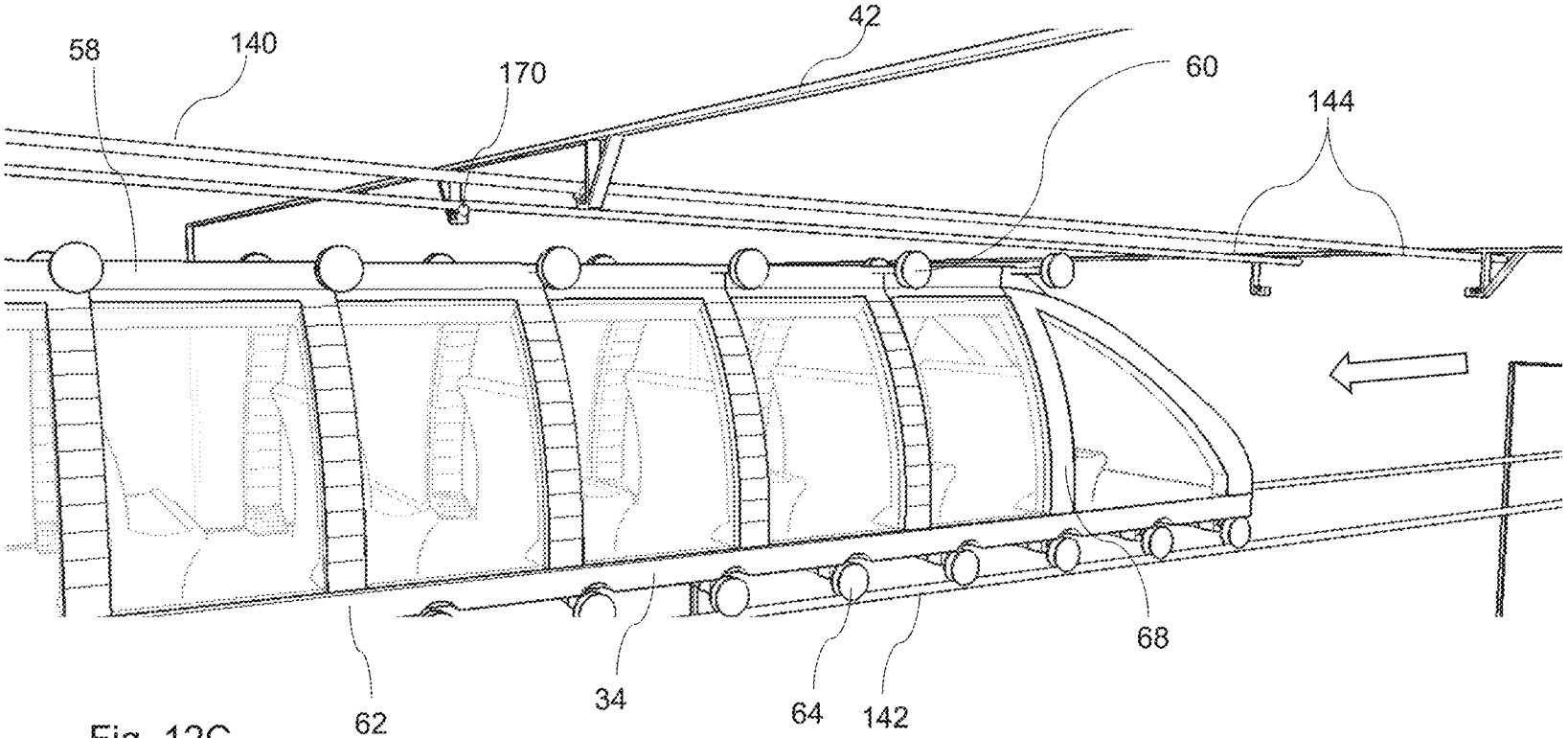
FIG. 12C is a side perspective view of a vehicle moving along the second auxiliary track.
Figure 12D:
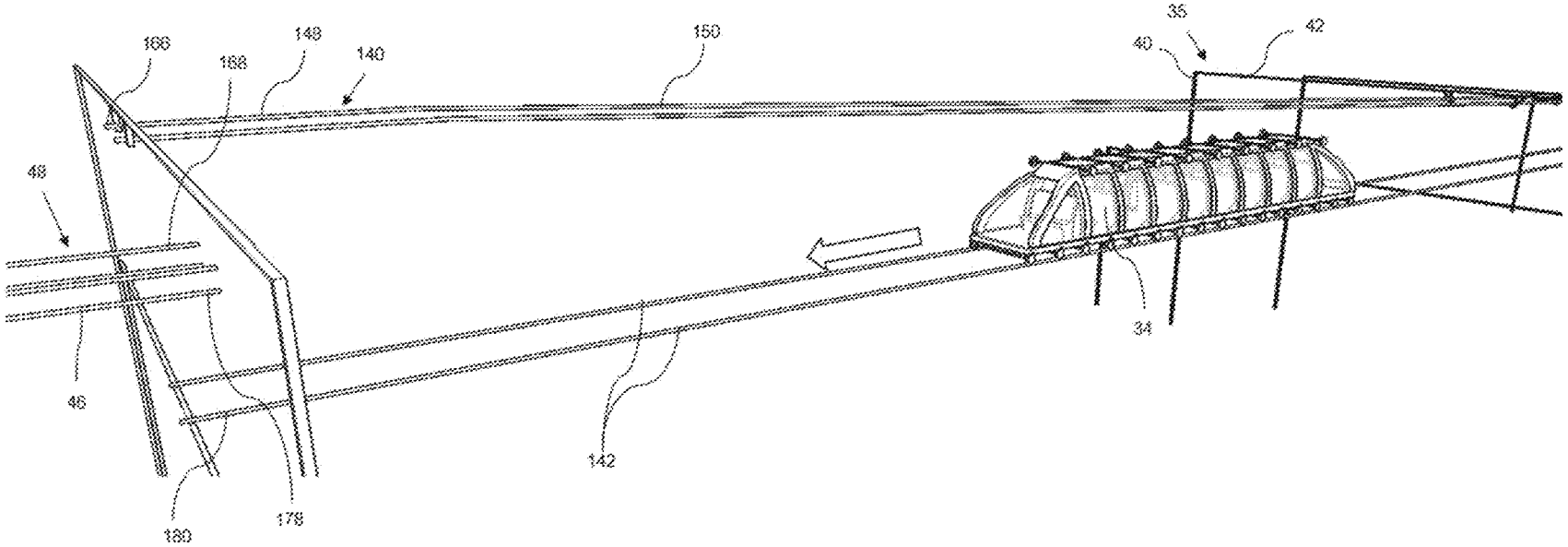
FIG. 12D is a second side perspective view of a vehicle moving along the second auxiliary track.

Referring to FIG. 12C, a side perspective view of a vehicle 34 moving along the second auxiliary track 142 is shown. The vehicle 34 continues to move along the second auxiliary track 132 under the mobile track 144 which is in the up, raised. position. The vehicle 34 continues along the second auxiliary track 142 towards the lower track 46 as seen in FIG. 12D.

In an embodiment, the support structure 38 transportation system 30 has horizontal supports 42 generally spaced at sufficient intervals to ensure structural integrity. In locations where the transportation system 30 has vehicles 34 changing tracks 32 or passengers 76 entering or exiting from the vehicles 34, the horizontal supports 42 are more closely spaced. The support structure 38 on the left side of FIG. 12D has a plurality of horizontal supports 42 including a horizontal support 42 to support the second auxiliary, a second horizontal support 42 to support both the upper track 48 and the lower track 46, and a third horizontal support 42 to support the first auxiliary track 140. Some of the supports have been removed for clarification of the FIGS; there would be at least three horizontal supports.

Figure 13:
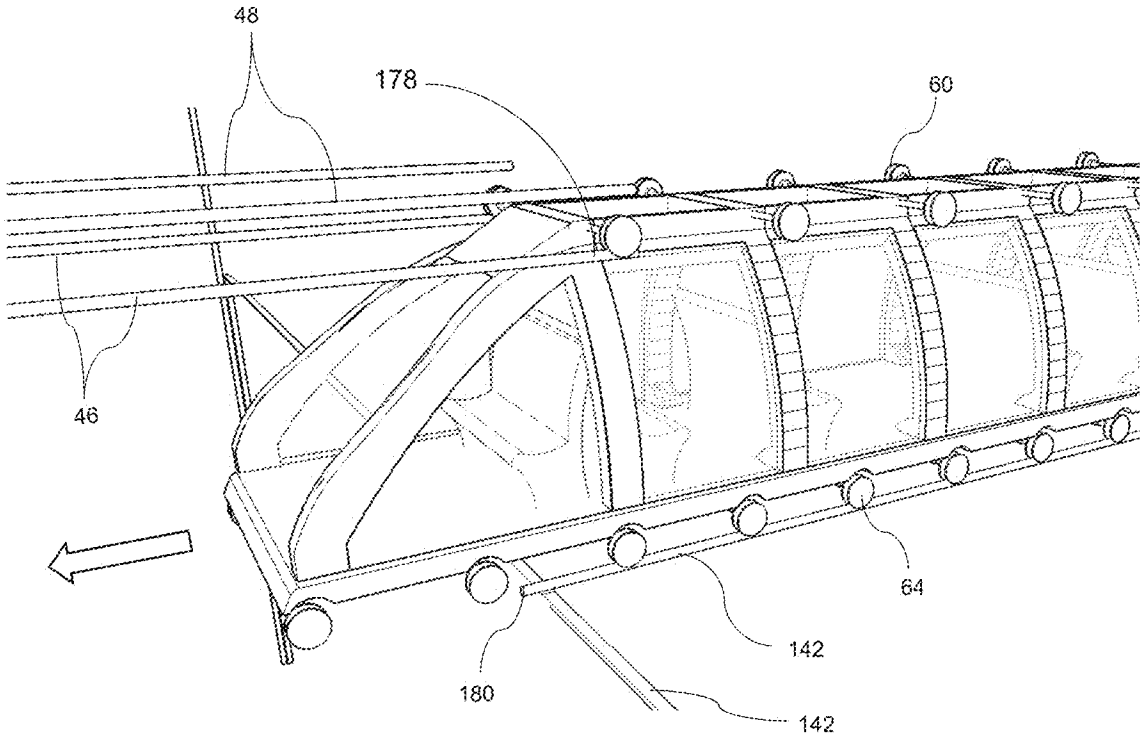
FIG. 13 is a side perspective view of moving a vehicle from the second auxiliary track to the lower track.

Referring to FIG. 13, a side perspective view of a moving a vehicle 34 from the second auxiliary track 142 to the lower track 46 is shown. The lower wheels 64 continue along the second auxiliary track 142 as the first of the upper wheels 60 are received by a terminus point 178 of the lower track 46. The vehicle 34 continues along until the entire vehicle 34 is supported by the lower track 46 via the upper wheels 60 and the upper support structure 58.

Figure 14A:
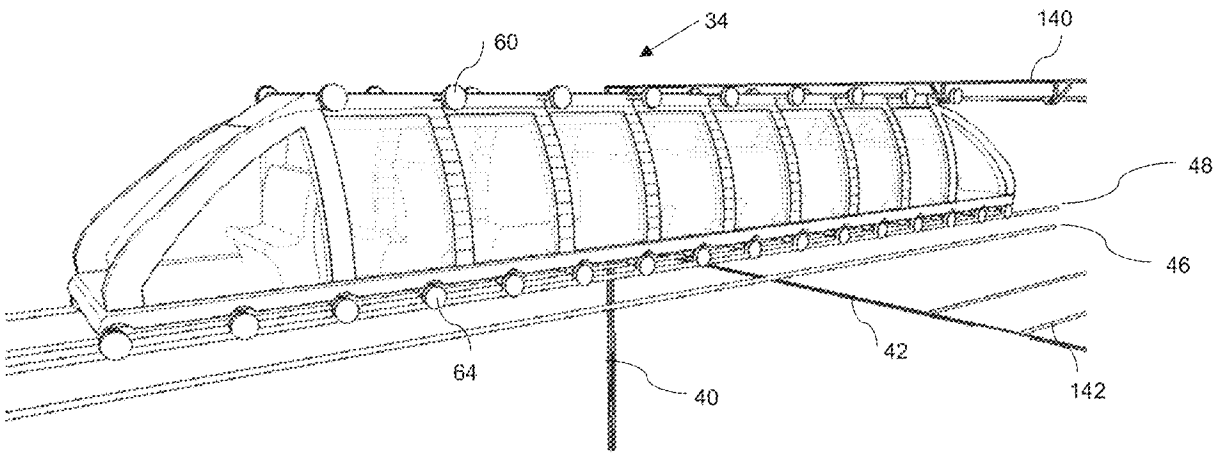
FIG. 14A is a side perspective view of the vehicle on the upper track.
Figure 14B:
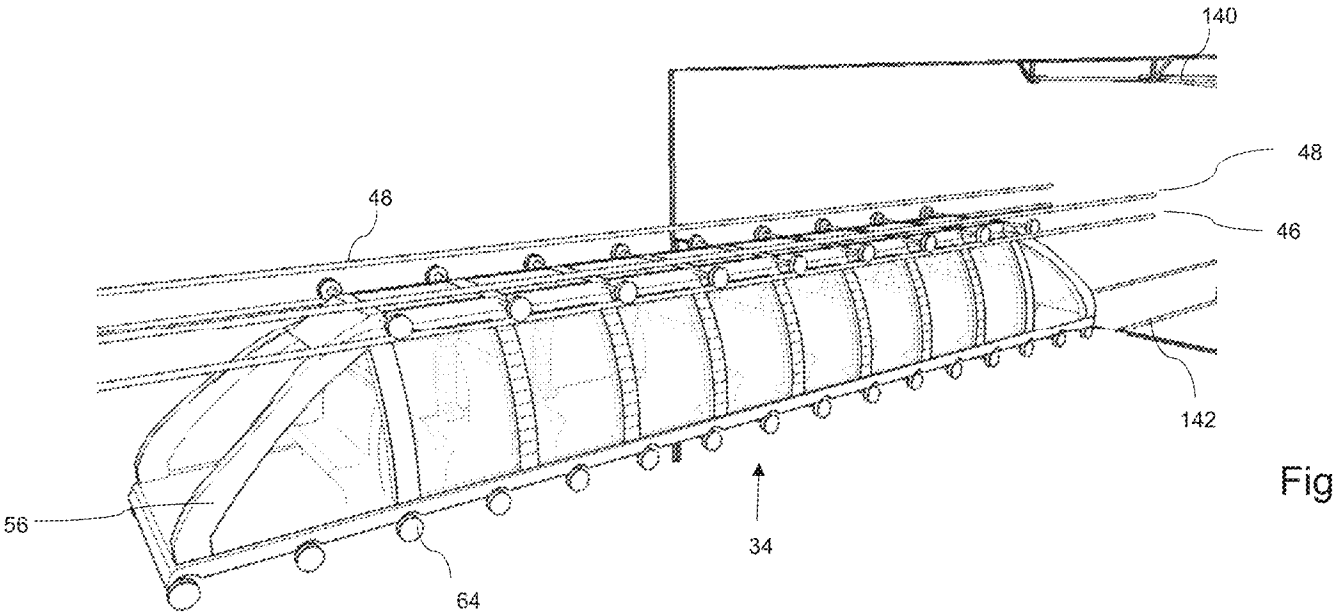
FIG. 14B is a side perspective view of the vehicle on the lower track.

Briefly reiterating the process, the vehicle 34 which is shown on the upper track 48 as seen in FIG. 14A is moved to the lower track 46 as seen in FIG. 14B via the first auxiliary track 140, the mobile track 144, and the second auxiliary track 142

Figure 15A:
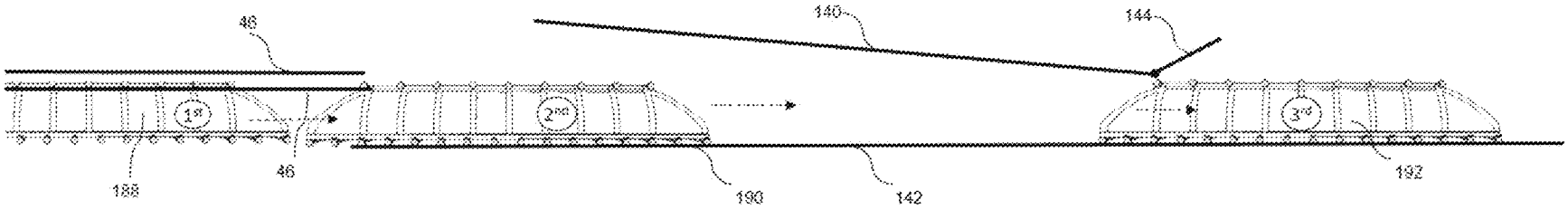
FIG. 15A is a side schematic of the first portion of a vehicle moving from the lower track to the upper track.
Figure 15B:
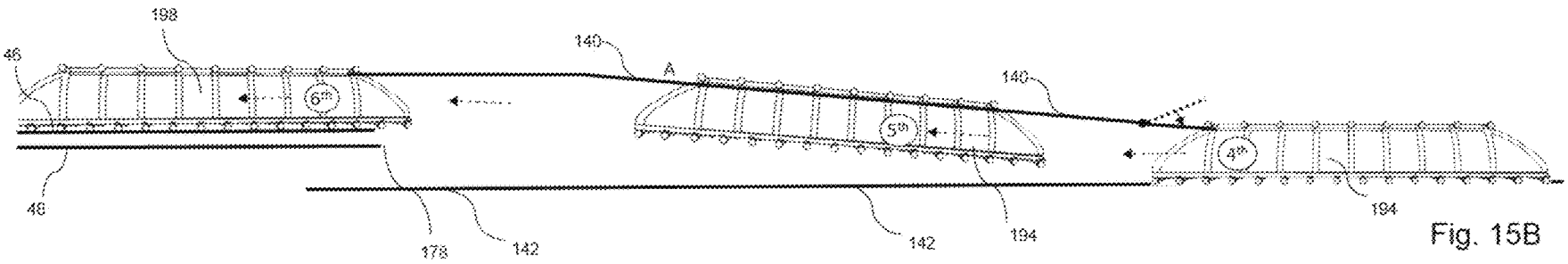
FIG. 15B is a side schematic of the second portion of a vehicle moving from the lower track to the upper track.

It is contemplated that at one end of a point to point, the vehicles 34 move from the upper track 48 to the lower track 46 and at the other end, the vehicles 34 move from the lower track 46 to the upper track 48. Referring to FIG. 15A, a side schematic of the first portion of a vehicle moving from the lower track to the upper track is shown. The incline between levels can vary. In the embodiment shown, the grade of the first auxiliary track in an embodiment is at a grade of 4 percent. When the vehicle 34 is moving between the upper track and the lower track, the vehicle 34 has no passengers 76 so has the minimum weight. In addition, all the wheels, both the upper wheels 60 and the lower wheels 64 are powered to create additional drive where needed. The vehicle 34 has many small wheels with powerful electric motors allowing the vehicle to be nimble. The vehicle 34 moves in reverse from what was explained with respect to FIGS. 9A-14B. The vehicle 34 moves from the lower track 46 to the second auxiliary track; from $1^{st}$ position 188 to a $2^{nd}$ position 190. The vehicle 34 continues to move until the vehicle 34 is in position so that the upper wheels 60 are in a position to be received by the mobile track 144 which is shown in a $4^{th}$ position 194 as seen in FIG. 15B. The vehicle 34 moves up the first auxiliary track 140 as shown in a $5^{th}$ position 196. The vehicle 34 continues on to the upper track 48 as shown in a $6^{th}$ position 198 as seen in FIG. 15B.

Tiered Depots

Dependent on the passenger volume in/on the transportation system 30, not all the vehicles 34 would be on the tracks 32 between the stations, the platforms 112. The extra vehicles 34 may be stored in a depot 206. Using the same method described with respect to FIGS. 9A-15B for switching from different level tracks 32 the train can be moved to further levels via the auxiliary tracks vertically for purposes of depot storage, maintenance, or switching to different routes.

Figure 16:
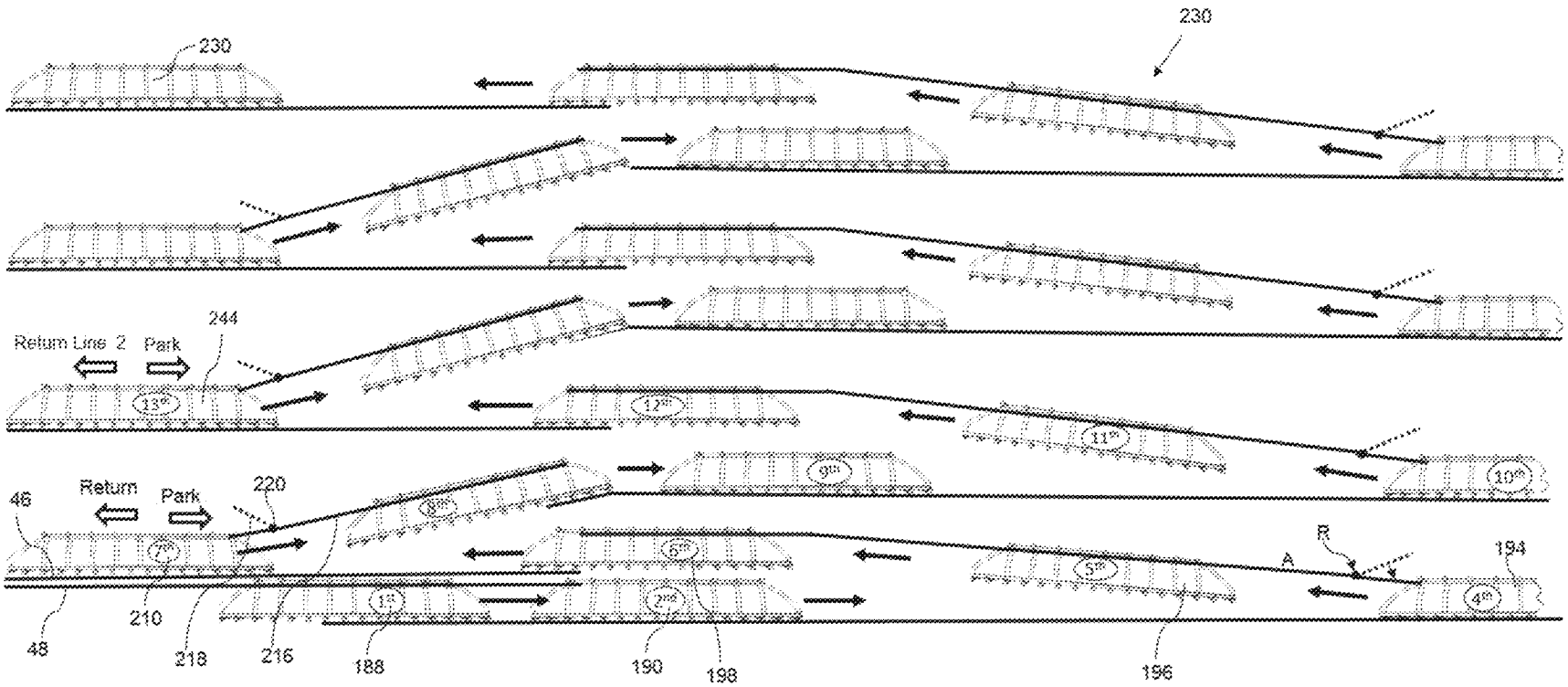
FIG. 16 is a schematic of a depot.

The moving from the $1^{st}$ position 188 on the lower track 46 to the $6^{th}$ position 198 onto the upper track 48 was described above with respect to FIGS. 15A and 15B. FIG. 16 shows a schematic of the vehicle 34 continuing up in the stacked depot 206.

Referring to FIG. 16, a schematic of the depot 206 is shown. The vehicle 34 continues to the $7^{th}$ position 210. From the $7^{th}$ position 210, the vehicle 34 can either move in a return direction 212 on the upper track 48 to service passengers or in a park direction 214 using an auxiliary track—C 216. In order for the train to travel on the auxiliary track—C 216, a mobile track 218 moves down via a hinge 220. From here the vehicle 34 continues using the same principle as described in movement from the $1^{st}$ position 188 to the $7^{th}$ position 210 and at reaches the $13^{th}$ position 224 which is directly above the $7^{th}$ position 210. The vehicle 34 can continue in the direction showed by the arrows until it reaches a last position 230. The image in FIG. is a representation as to when the vertical depot is full, in this case storing 24 vehicles 34. The vehicles 34 can stored on the incline with the vehicles 34 having many small wheels and they are equipped with numerous brakes that can hold the vehicle on an incline.

Besides serving as a vertical depot the method described in FIG. 16 can also serve as a central station from where vehicles 34 can depart in multiple directions. In the same way as the train can move to Return direction or to Park from the $7^{th}$ position it can have the same dual option in the $4^{th}$, $10^{th}$, $13^{th}$ positions (and the same applies for the trains in the two levels above) from where the train can either move to park in the depot as shown by the arrows or leave the depot to service passengers, as shown in example at position $13^{th}$ Return Line 2.

Intersection of the Tracks

In the transportation system 30, it is expected that the system 30 will have multiple lines and in certain locations the tracks 32 will intersect. Referring to FIG. 17A, a perspective view of a pair of intersecting tracks 250 for the upper track 48 is shown. Where a pair of rails 50 intersect, there is an intersecting frog 252. It is recognized that for the upper track 48 the intersecting frogs 252 are similar to conventional frogs. There are differences which are explained with respect to FIGS. 18A and 18B.

Figure 17B:
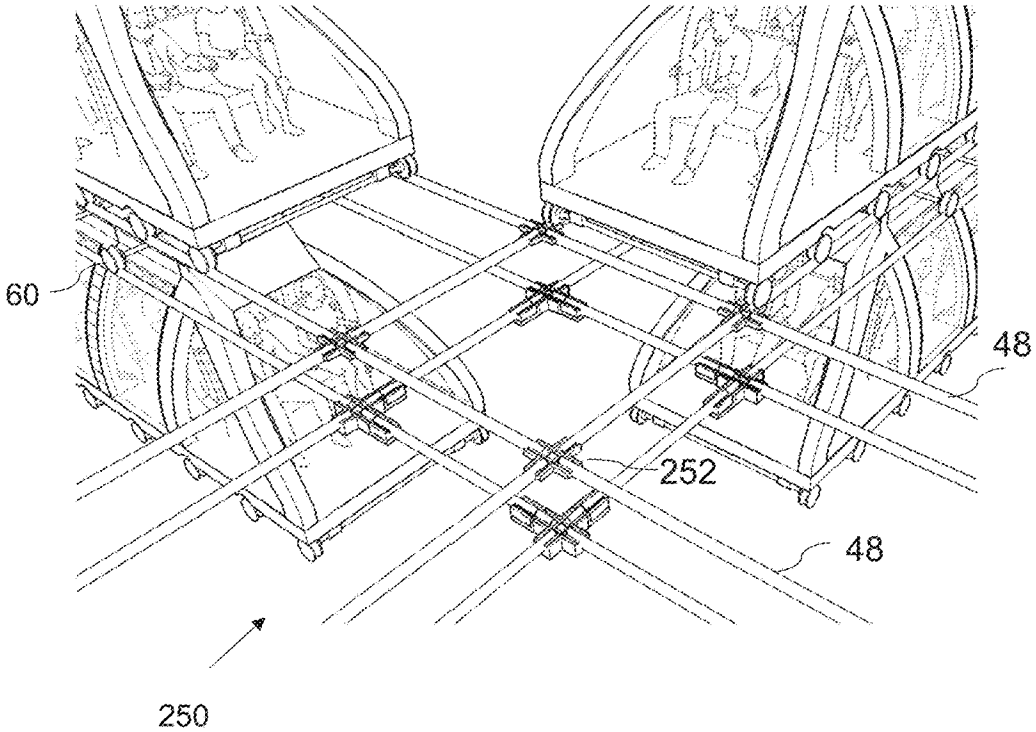
FIG. 17B is a perspective view of a pair of intersecting upper tracks and a pair of intersecting lower tracks.
Figure 17A:
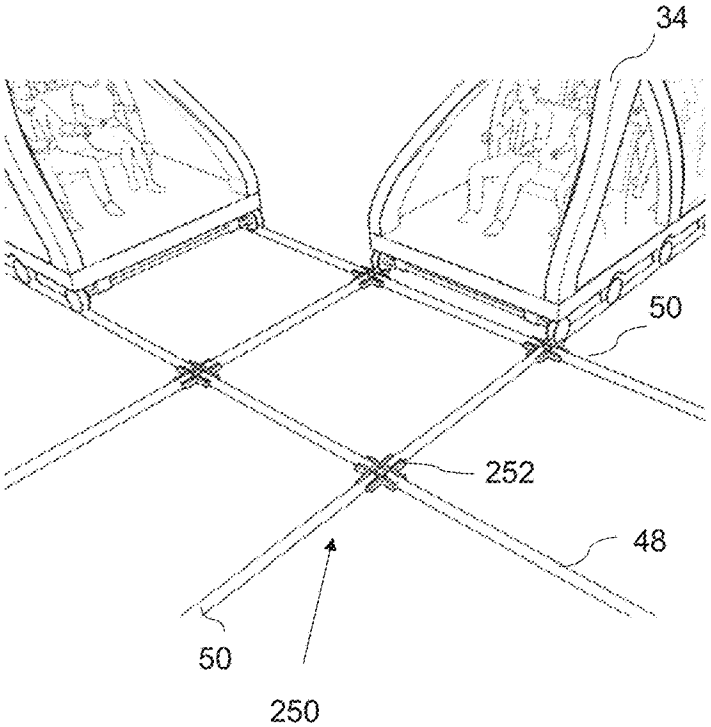
FIG. 17A is a perspective view of a pair of intersecting tracks.

Referring to FIG. 17B, a perspective view of a pair of intersecting upper tracks and a pair of intersecting lower tracks is shown. As with just having the upper wheels 60 roll on the lower track 46, there are issues related to potential interference issues.

Figure 18B:
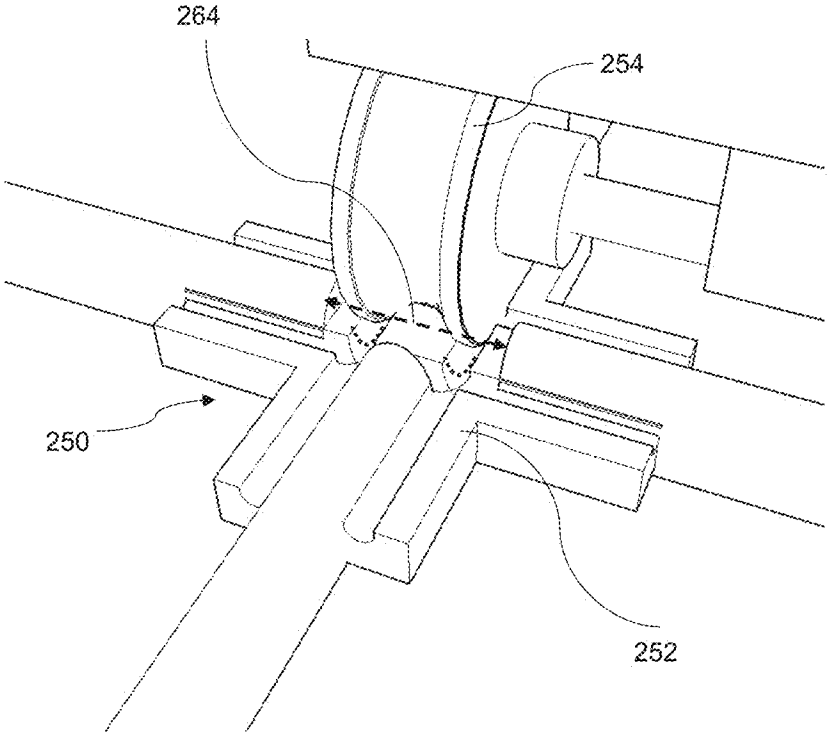
FIG. 18B is another perspective view of a pair of intersecting rails with a wheel at the intersection.
Figure 18A:
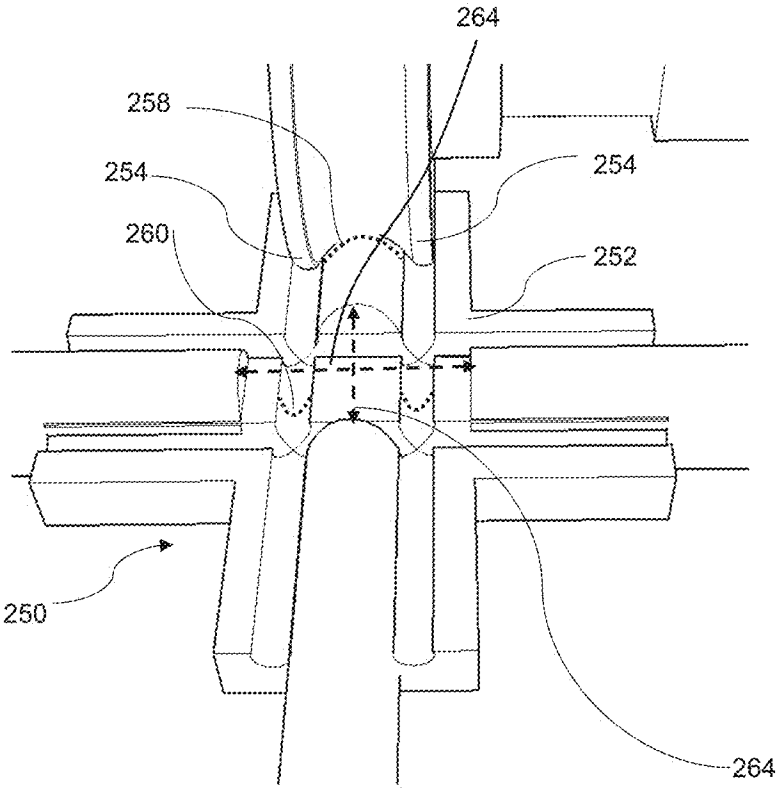
FIG. 18A is a perspective view of a pair of intersecting rails.

Referring to FIG. 18A, a perspective view of a pair of intersecting rails is shown. When the wheel, either the upper wheel 60 or the lower wheel 64, is traveling along the rail 50 the outer sides 254 of the wheels 60 and 64, such as seen in FIGS. 4A and 4B, are located such that the rail 50 is between the sides 254. The transition is shown from support of the inner area 256 of the wheel 60 and 64 by the track area described by dotted line 258 as seen in FIG. 18A to support of the outer sides 254 of the wheel 60 and 64 by concave auxiliary tracks 260 as shown in FIG. 18B. The intersecting track 250 has an area cut out as represented by an arrow 264 in order to allow the wheels to cross the tracks.

Figure 19A:
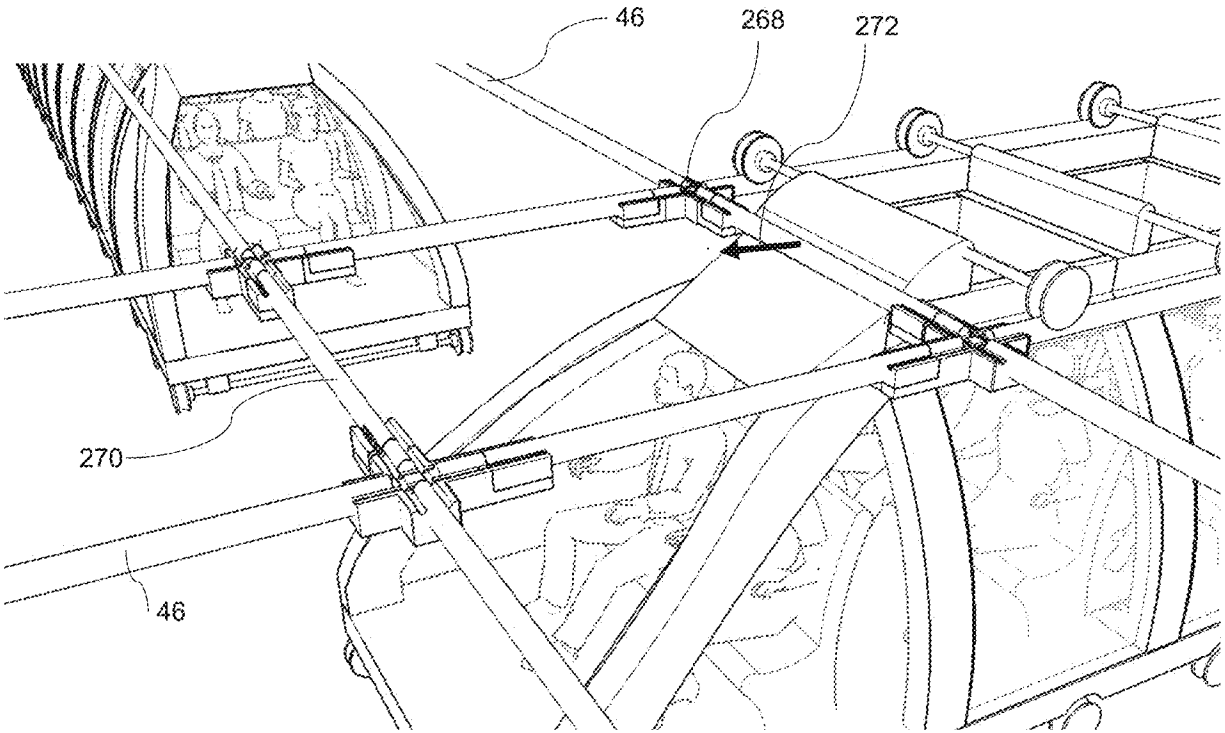
FIG. 19A is a perspective view of a pair of lower tracks intersecting.

Referring to FIG. 19A, a perspective view of a pair of lower tracks 46 intersecting is shown. The vehicle 34 on the lower track 46 approaches an intersection 250 showing the upper support structure 58 and potential interference with a rail 50 of the intersecting track 250. The lower tracks intersection 268 requires a gate section 270 of the track 46 to open in order to enable the upper support structure 58 that receives the upper wheels 60 of the vehicles 34, as represented by the arrow 270 to pass by the intersecting track 268.

Figure 19B:
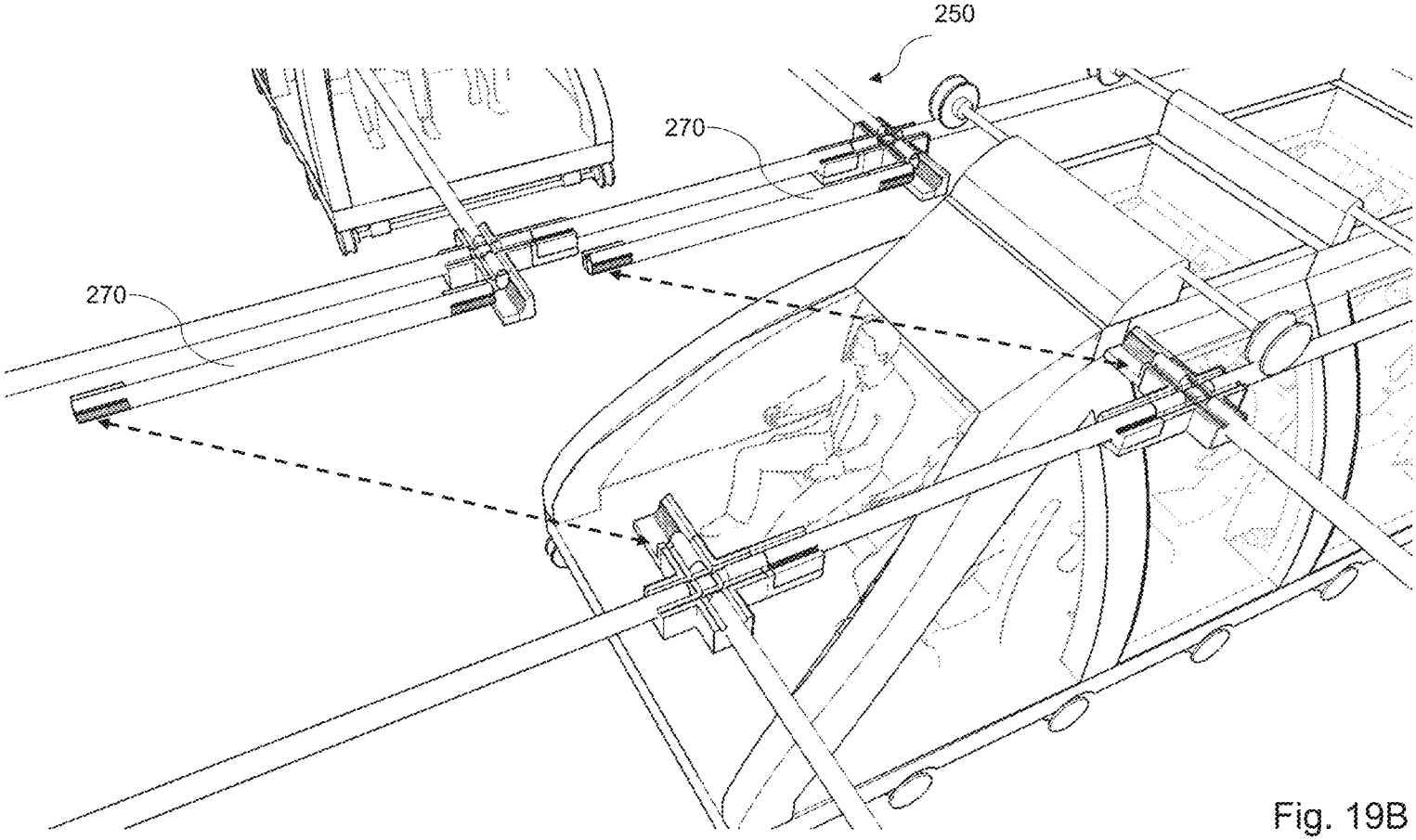
FIG. 19B is a perspective view of the pair of the lower tracks with a gate.

The gate section 270 of the tracks 46 opened as described by dotted line arrow to allow the train to pass as shown in FIG. 19B.

A system of gates that open to allow sections holding the upper wheels of the train to pass across intersecting tracks is shown. The transportation system 30 is using vehicles 34 that are relatively light weight compared to conventional trains for the reasons stated above. The transportation system 30 is using vehicles 34 that will be lighter than conventional transportation such as buses, trains, and streetcars.

Figure 19D:
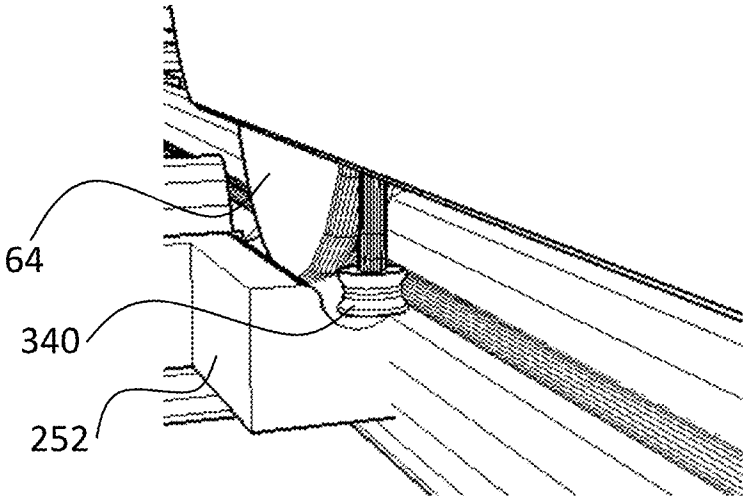
FIG. 19D is another perspective view of a pair of intersecting rails with a horizontal safety rail projecting from the vehicle.
Figure 19C:
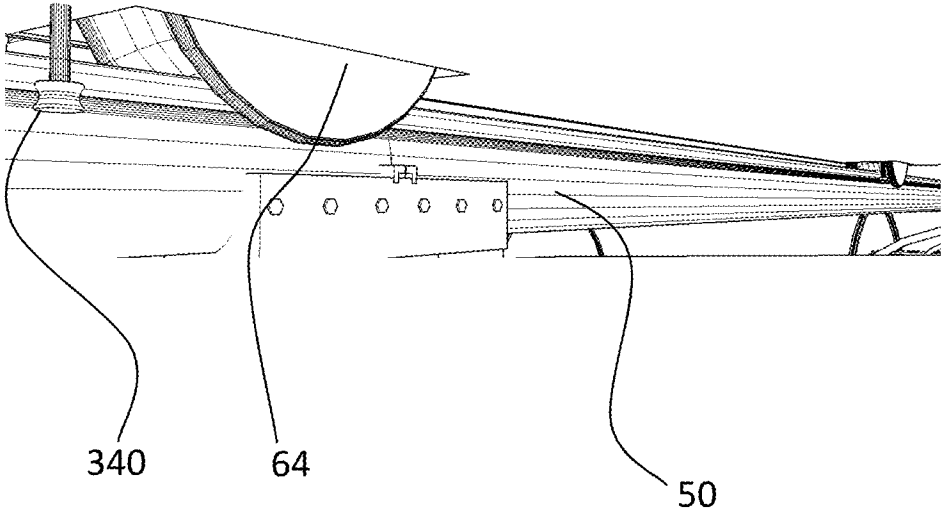
FIG. 19C is a perspective view of the lower wheel of the vehicle on the rail of the upper track.

Referring to FIG. 19C, a perspective view of a lower wheel 64 of the vehicle 34 on a rail 50 of the upper track 48 is shown. The vehicle 34 in addition to the plurality of lower wheels 64 that rolls along the rails 50 of the upper track 48, has a plurality of horizontal safety wheels 340 that engage the side of the rail 50 to provide stabilization against derailment.

Referring to FIG. 19D, another perspective view of a lower wheel of the vehicle 34 on a rail 50 of the upper track 48 is shown. The lower wheel 64 is passing over the intersecting frog 252. The horizontal safety wheel 340 is located above the intersecting frog 252 so that there is no interference. The horizontal safety wheel 340 rotates about shaft and has a rotational diameter is smaller in diameter than groove, the concave auxiliary tracks 260.

Figure 20A:
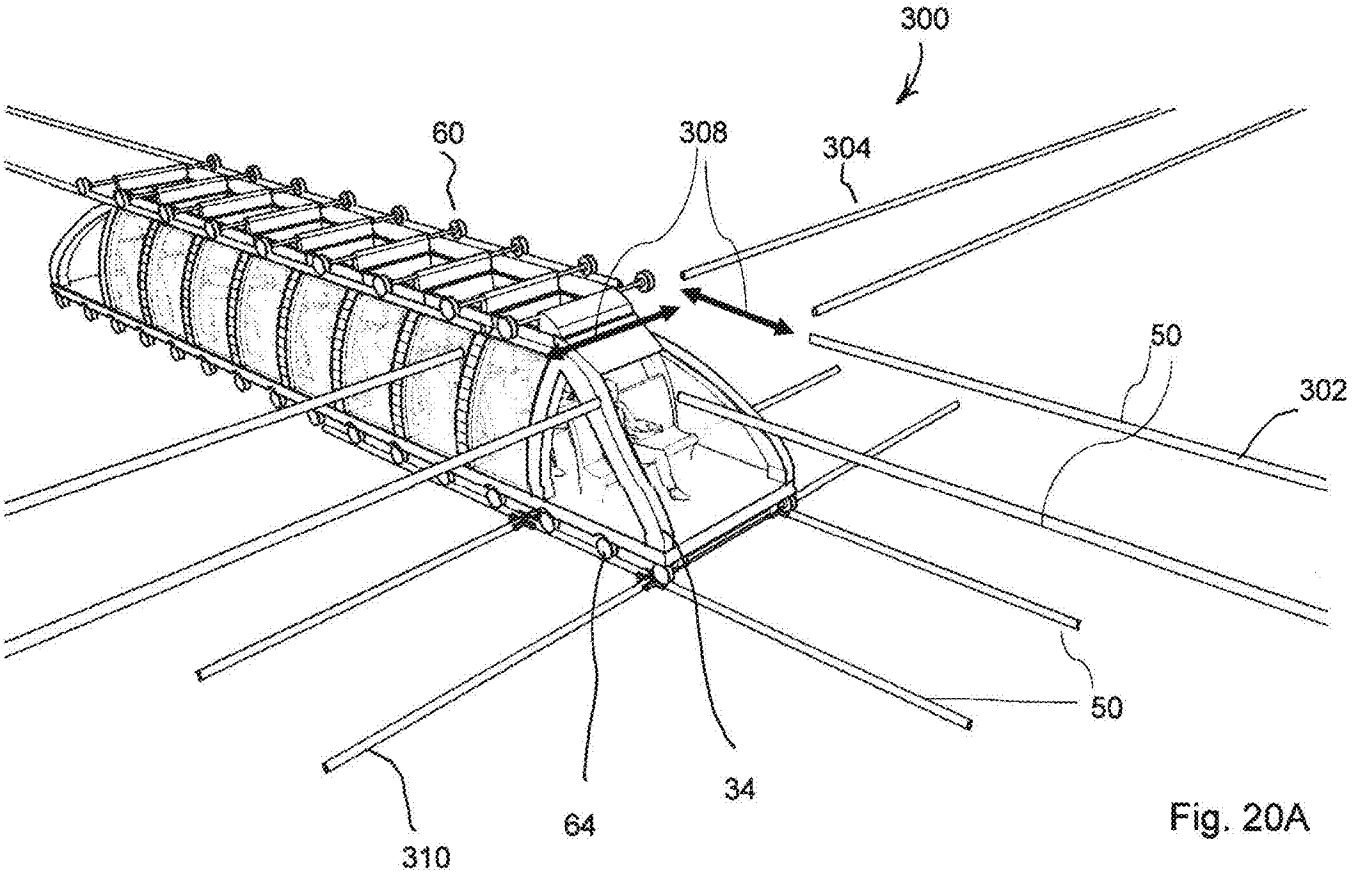
FIG. 20A is a perspective view of an alternative embodiment of a pair of lower tracks intersecting and a vehicle.

Referring to FIG. 20A, a perspective view of an alternative embodiment of a transportation system 300 with a pair of lower tracks 302 and 304 intersecting and a vehicle 34 is shown. In contrast to the previous embodiment where a pair of rails 50 intersect and there are gates to allow movement as seen in FIG. 19A and FIG. 19B, the system 300 has a gap 308 in the rails 50 of the lower tracks 302 and 304 so none of the rails 50 engage each other. In addition, the transportation system 300 has a lower crossing support track 310. As the vehicle 34 moves along the track 302, the upper support structure 58 can pass through the gap 308. The vehicle 34, the train, is supported by the lower crossing support track 310. The lower crossing support track 310 has rails and intersecting frogs 252 similar to the intersecting frogs 252 on the upper track 48 in FIG. 17A upon which the lower wheels 64 can ride. The spacing of the lower crossing support structure track 310 is such that the upper wheels 60 are aligned and ride onto and off of the lower tracks 302 similar to the alignment used with the alignment tracks 32 in the switching tracks and depots as discussed with respect to FIGS. 9A-16.

Figure 20B:
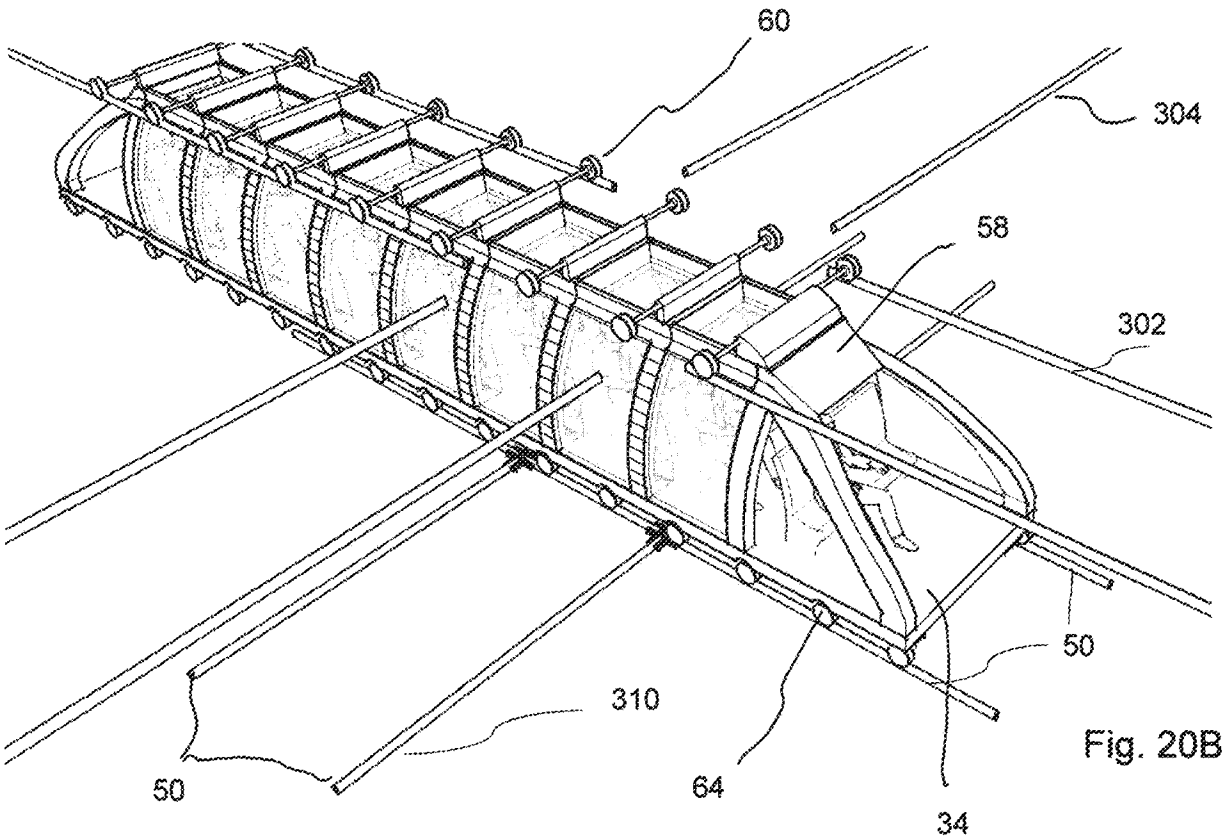
FIG. 20B is the perspective view of the alternative embodiment of FIG. 20A with the vehicle moved along one of the lower tracks.

Referring to FIG. 20B, a perspective view of the alternative embodiment of the transportation system 300 FIG. 20A with the vehicle 34 moved along one of the lower tracks 302 is shown. While the first set of upper wheels 60 is shown in the gap 308 and the first several sets of lower wheels 64 are on the lower crossing support track 310 in FIG. 20A, the first set of upper wheels 60 is shown received on the rails 50 and the lower track 302. The majority of the lower wheels 64 are shown riding on the rails 50 of the lower crossing support track 310.

Figure 20C:
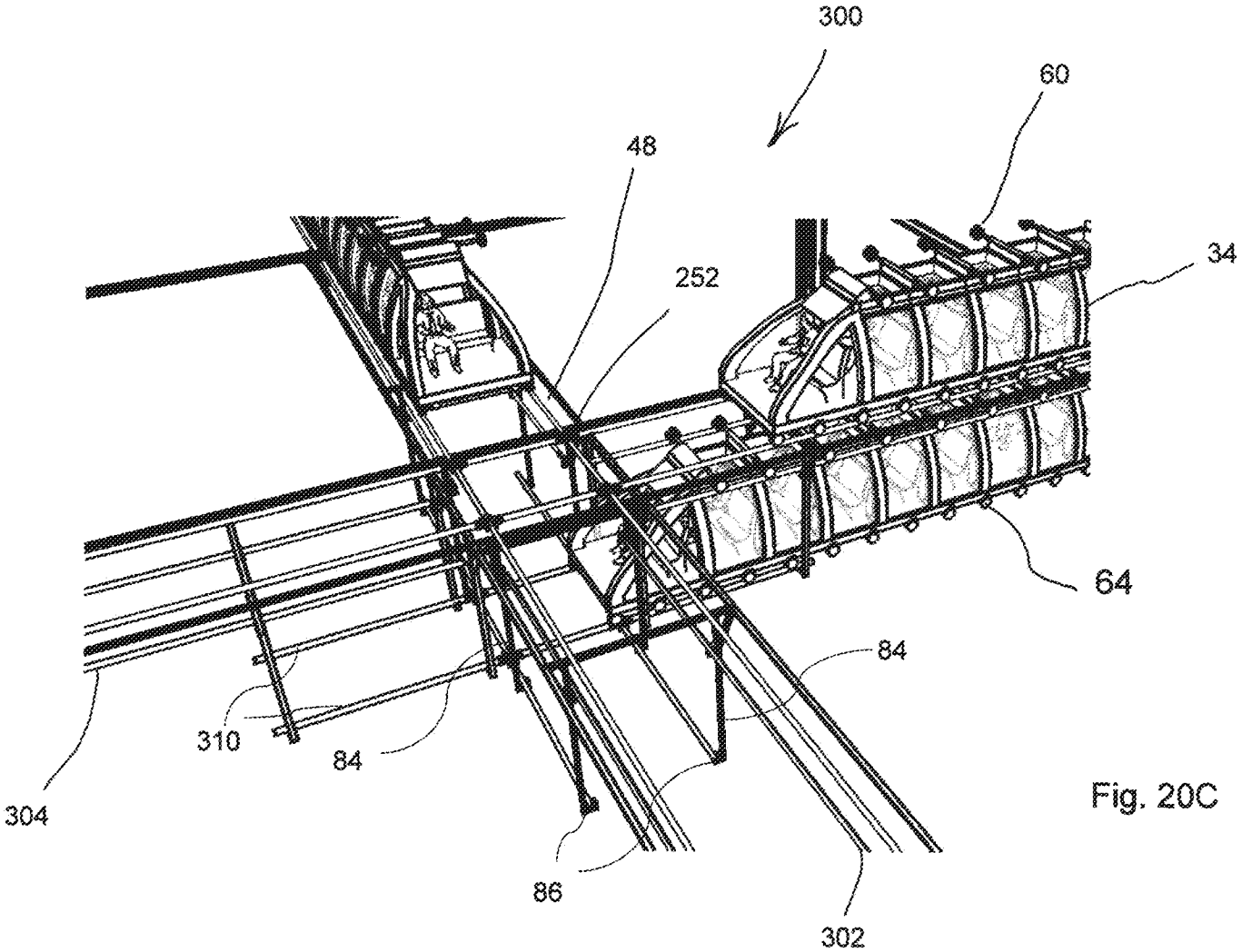
FIG. 20C is a perspective view of the alternative embodiment showing both an upper track having an intersecting frog and the lower track with a crossing support track.

Referring to FIG. 20C, a perspective view of the alternative embodiment of the transportation system 300 showing both an upper track 48 having intersecting frogs 252 and the lower tracks 302 and 304 with a crossing support track 310 is shown. The intersecting frogs 252 are described above with respect to FIG. 18A and FIG. 18B.

The rails of the lower crossing support track 310 are supported by a hook-shaped extension 86 which supports the rails 50 of the lower crossing support track 310. In the embodiment shown, the support structure 38 includes vertical support extensions 84 that extend from the horizontal supports 42.

It is recognized that the tracks 32 can intersect at a different angle than 90 degrees. For example, the tracks can intersect in a range of 30 degrees to 150 degrees.

Figure 20D:
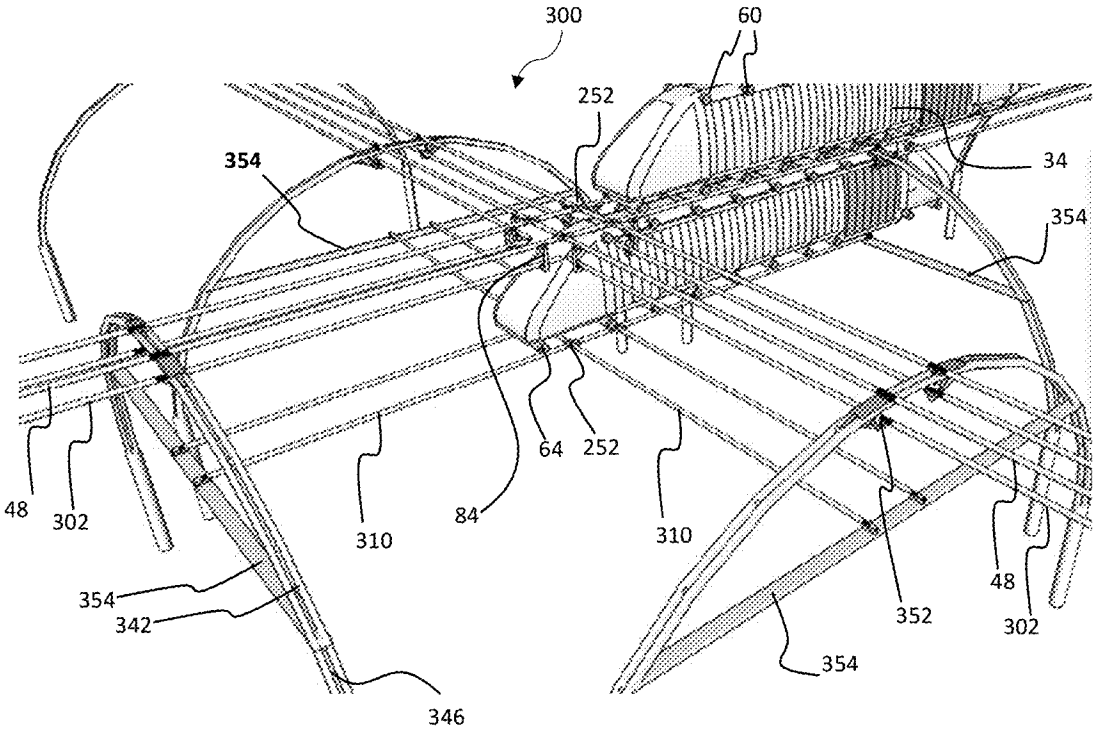
FIG. 20D is a perspective view of an alternative embodiment showing both an upper track having an intersecting frog and the lower track with a crossing support track.

Referring to FIG. 20D, a perspective view of an alternative embodiment of the transportation system 300 showing both an upper track 48 having an intersecting frog 252 and the lower track 302 with a lower crossing support track 310 is shown. The system 300 has a plurality of arches 342 supporting the upper track 48 and the lower track 302. The rails 50 of the upper track 310 are secured on the upper side of the arch 342. The rails 50 of the lower track 302 are secured to the lower side of the arch 342 by a bracket 352.

The lower crossing support track 310 that is used in association with the lower track 302 to allow the vehicle 34 to cross an intersection, is supported by a plurality of arched horizontal supports 354 that extend between two portions, the legs 346 of the arch 342. The intersecting frog 252 of the upper track 48 is similar to that in the previous embodiment.

Figure 21:
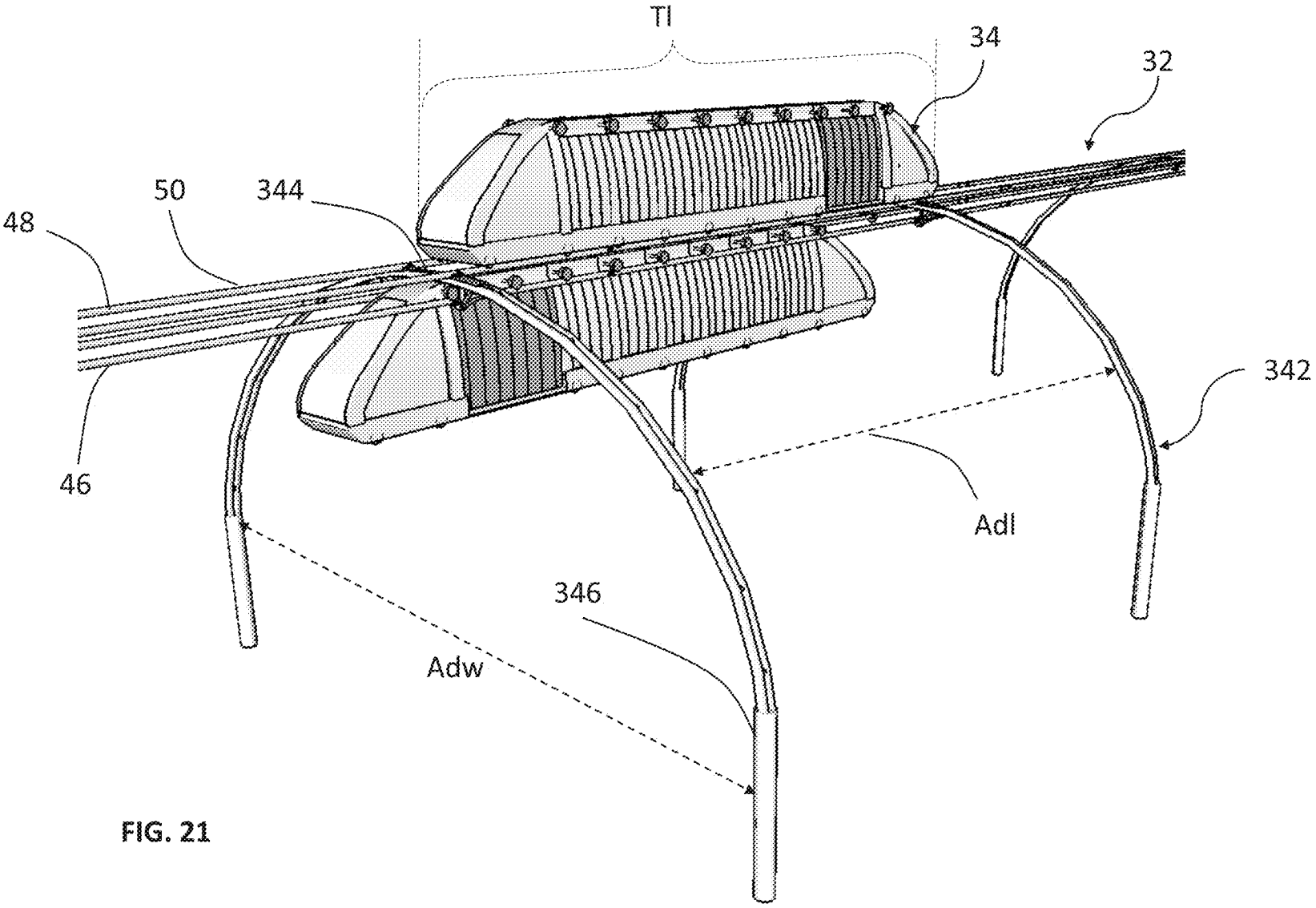
FIG. 21 is a perspective view of an alternative support structure system.

Referring to FIG. 21, a perspective view of an alternative support structure system 38 is shown. In order to minimize the visual impact of the supporting structures system 38, the system has a plurality of arches 342 in contrast to a series of vertical supports 40 and horizontal supports 42 as shown in FIG. 21. The arches 342 provide an optimum model for minimal thickness while maximizing support. The rails 50 of the upper track 48 and the lower track 46 are located in proximity to the apex 344 of the arch so that the weight of the tracks 32 and the vehicle 34 are distributed along both legs 346 of the arch 342. By being placed at the center of the arches 342, the weight of the vehicle 34 is spread equally to both sides or legs 346 of each arch 342 across distance Adw in FIG. 21.

In order to minimize the thickness of the rails 50, the distance Ad1 between the arches 342 does not exceed the length T1 of the vehicle 34 so the weight of the vehicle 34 is borne by the arches 342 rather than the rails 50. The spacing of the arches 342 allows for the rails 50 to be thinner in order to reduce visual impact on the city landscape. However other factors may be considered if technologies allow for rails to bear the weight of the train while having longer distances between the arches. It is recognized that in certain embodiments, that it may be desirable to use a truss structure to space the arches further apart as discussed below, while in other embodiments, it may desirable to have the arches closely spaced as shown in FIG. 21.

The frequency of supporting arches at a distance between supporting arches at less than the length of a train allows for minimally thick rails as the weight of the trains is born by the arches rather than the rails.

Figure 22B:
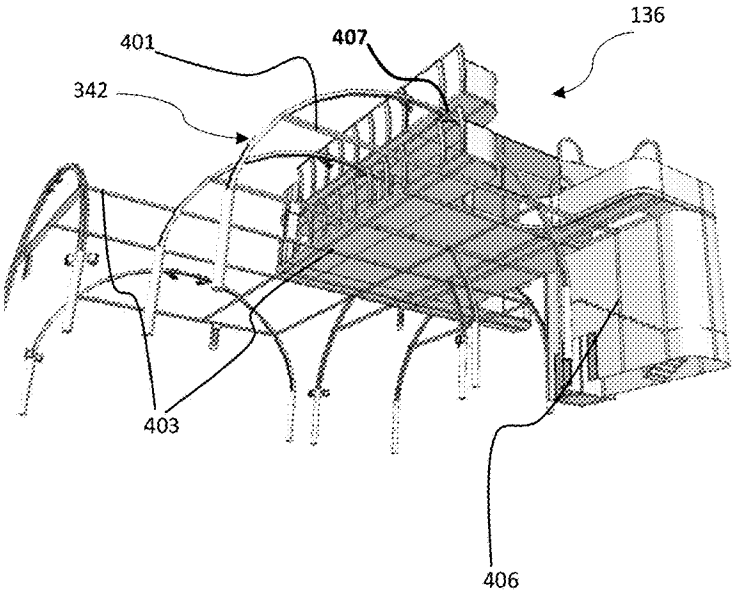
FIG. 22B is alternative perspective view of the alternative station.
Figure 22A:
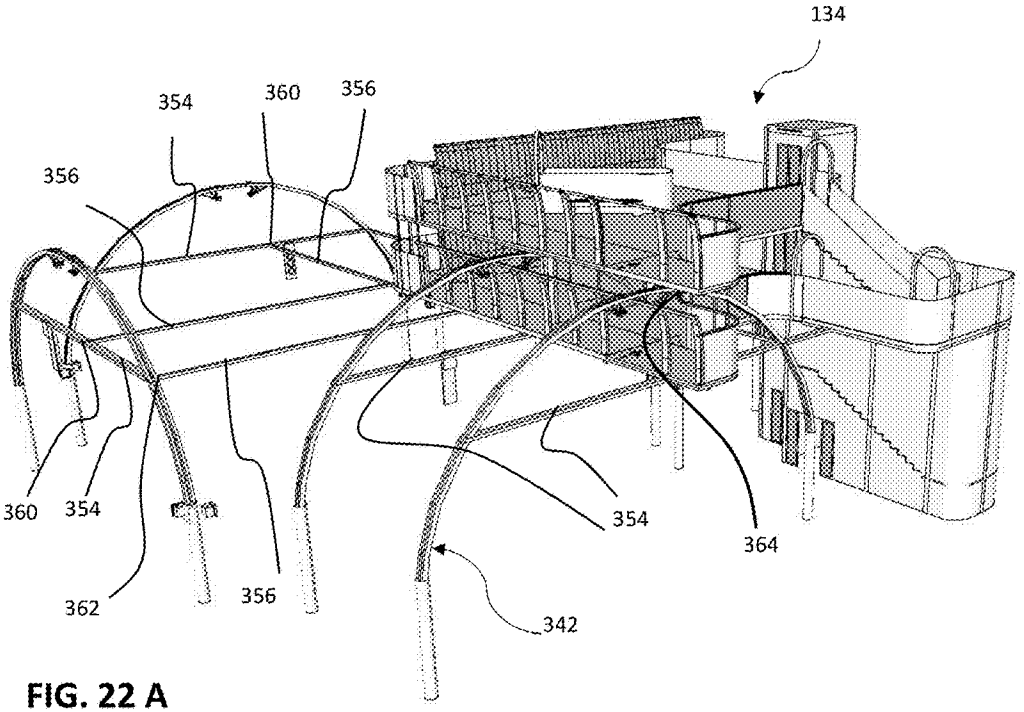
FIG. 22A is a perspective view of an alternative station.

Referring to FIG. 22A, a perspective view of an alternative embodiment showing a station 134 is shown. The upper track 48 and the lower track 46 are not shown for clarification in this FIG. The arches 342 have the arch horizontal support members 354 extending between the two sides of the arch 342 for additional structural support. In addition to providing support for the lower crossing support track 310 as shown in FIG. 20D, the horizontal support or connecting members 354 can provide support to the station 134 or to other members such as a secondary horizontal support member 356 that support the station 134. The arch horizontal support member 354 is connected to the secondary horizontal support 356 at an intersection point 360.

In addition, other support members connected to the arches 342 can provide support for the station 134. For example, a leg arch horizontal support member 358 is connected to one of the arches 342 at an intersecting point 362 and directly to the station 134. Likewise multiple support members can be used between an arch 342 and the station 134 such as mentioned above with respect to the horizontal support member 354 and the horizontal support member 356. In addition, one or more of the arches 342 can provide support for a station 134 without any connecting members as shown at point 364.

Referring to FIG. 22B, a bottom perspective view of the embodiment of FIG. 22A with the station 134 is shown. The view shows the plurality of horizontal members 354, 356, and 358 that provide support of the station 134. One of the horizontal support members 354 that extends between the two legs 346 of an arch 342 extends between the ends of one of the legs 346 of the arch 342 to connect with a vertical support member 366 which is part of a stairway structure 368 of the station 134.

Figure 22C:
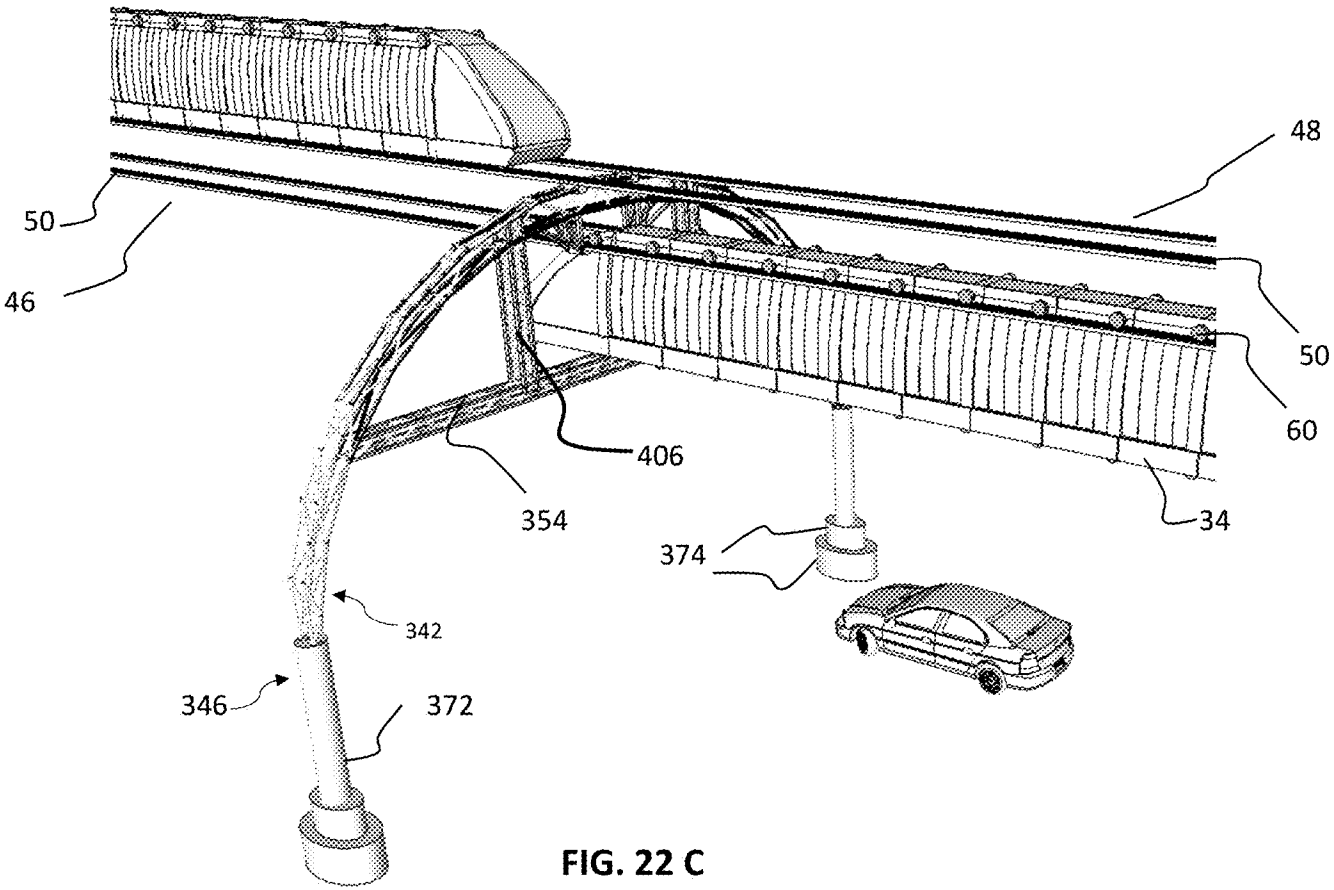
FIG. 22C is a perspective view of an arch with an upper track and a lower track.

Referring to FIG. 22C, a perspective view of an arch 342 with an upper track 48 and a lower track 46 is shown. The transportation system 300 shown has a pair of vehicles 34. The vehicle 34 on the upper track 48 has its lower wheels riding on the rails 50 of the upper track 48. Another vehicle 34, the vehicle 34 on the lower track 46, has its upper wheels 60 riding on the rails 50 of the lower track 46. The arch 342, in the embodiment shown, has a concrete pillar 372 around the lower portion of each leg 346 of the arch 342 to both support and protect the arch 342. The concrete pillar 372 has a pair of large annular portions 374 to improve protection of the arch 342 from accidental damage by a vehicle, such as a car or truck. The arch 342 has the horizontal cross support member 354 and a vertical support cross member 376. In the embodiment shown, the arch 342 is formed of a truss 382 having a plurality of members 384 to strengthen the arch 342 while minimizing the weight.

Figure 22D:
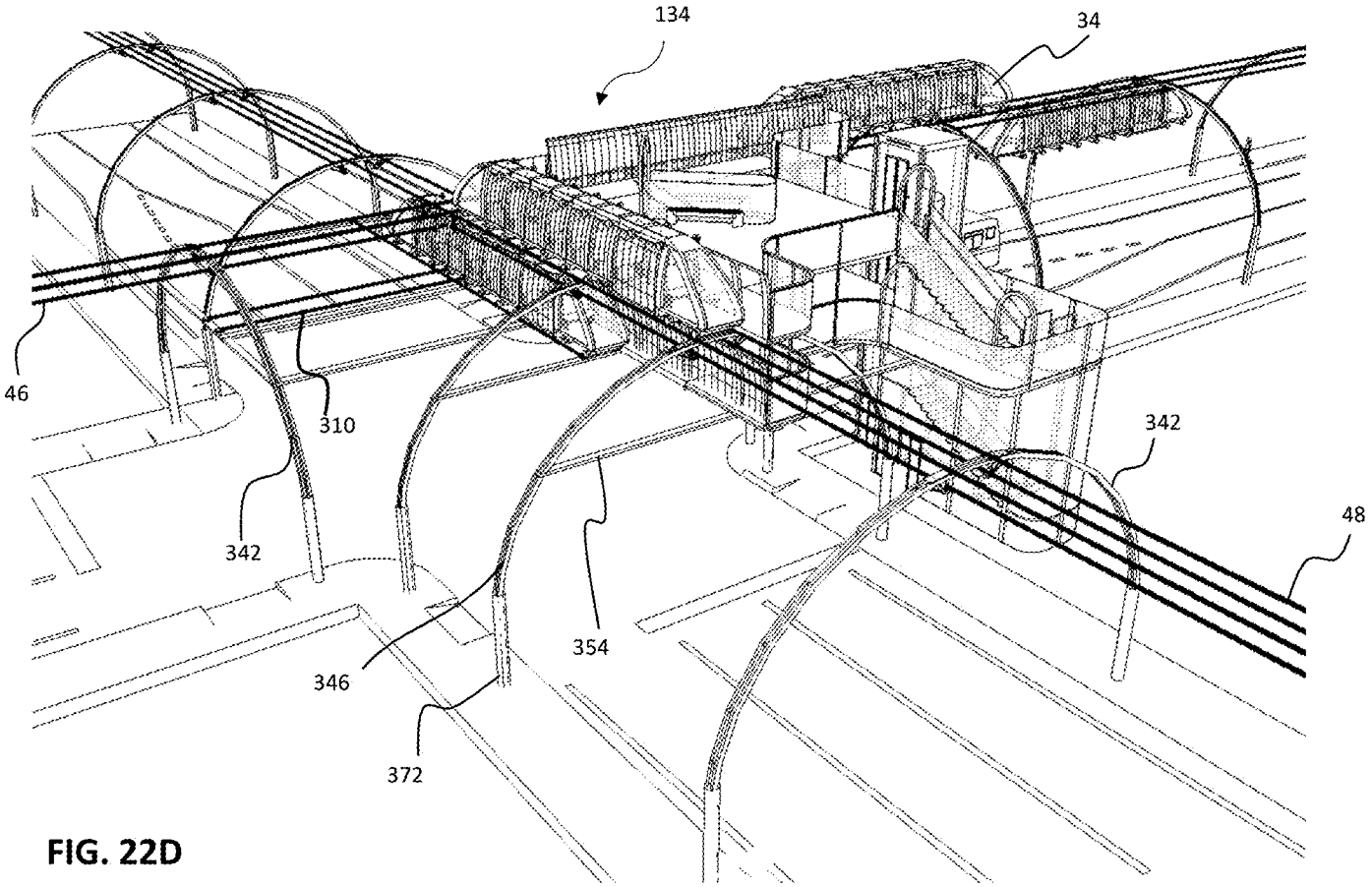
FIG. 22D is a perspective view an alternative station with tracks and vehicles.

Referring to FIG. 22D, a perspective view of the station 134 similar to FIG. 22A and including the upper track 48 and the lower track 46 is shown. The arches 342 have the horizontal support members 354 extending between the two sides or legs 346 of each of the arches 342 for additional structural support. In addition to providing support for the lower crossing support track 310 as shown in the FIG. and FIG. 20, the horizontal support connecting members 354 can provide support to the station 134 or to other members, such as a secondary horizontal support member 356, which support the station. It is recognized that certain arches 342 may not have the horizontal member 354 if not required structurally. For example, it may be desirable not to have the horizontal member 354, where it is not required, for aesthetic reasons.

In the embodiment shown, there are four vehicles 34 in or approaching the station 134. While it is contemplated that typically the vehicle 34 on the upper track 48 will be going in one direction and the vehicle 34 on the lower track 46 is going the other direction, the transportation system 300 can have both trains/vehicles 34 going in the same directions at certain times, for example towards or away from an event (e.g., sport, concert, . . . ).

Figure 23B:
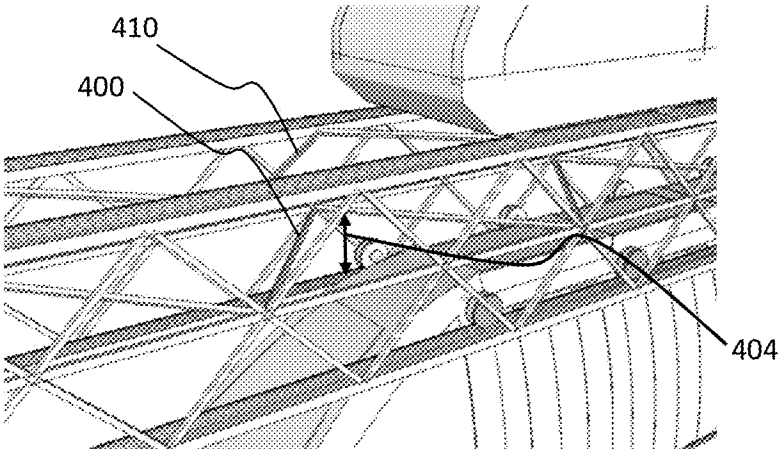
FIG. 23B is another perspective view of the truss system of FIG. 23A.
Figure 23C:
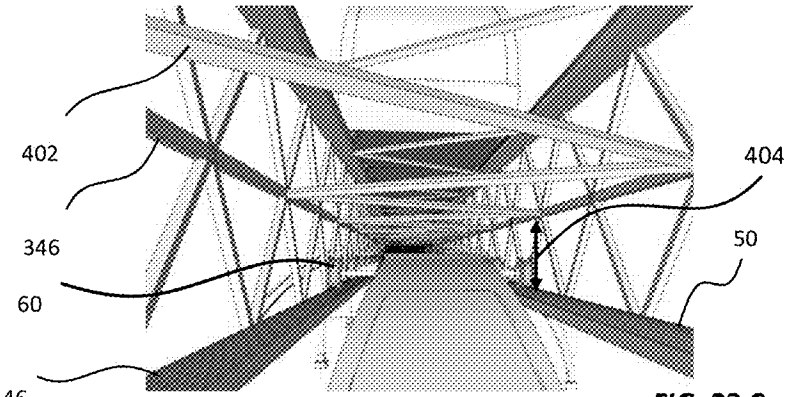
FIG. 23C is another perspective view of the truss system of FIG. 23A.
Figure 23A:
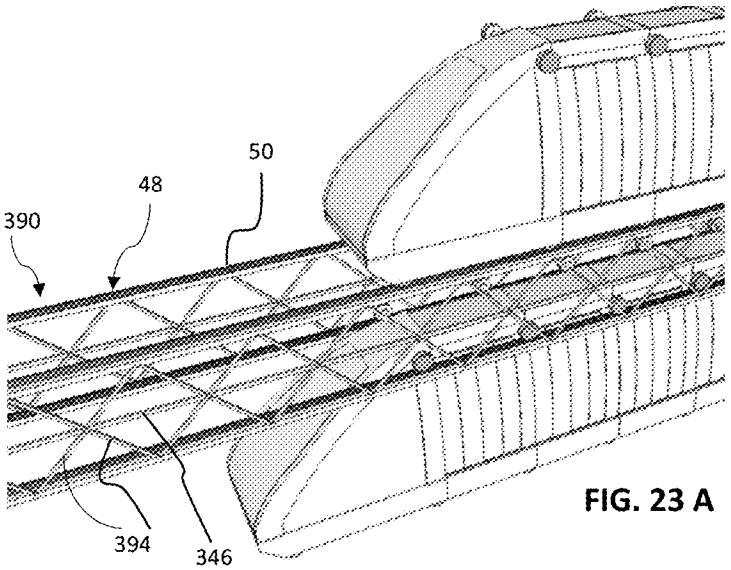
FIG. 23A is a perspective view of an upper track and a lower track with a plurality of truss systems.

Referring to FIG. 23A, a perspective view of an alternative embodiment of the upper track 48 and the lower track 46 with a plurality of truss systems 390 interposed is shown. The vehicle 34 rides on the upper portion of the rails 50 of the upper track 48. A plurality of members 394 of a generally vertical truss system 392 extend between one of the rails 50 of the upper track 48 and one of the rails 50 of the lower track 46. In the embodiment show, the generally vertical members 394 of the generally vertical truss system 392 intersect each other and have a horizontal member 396 that extends generally parallel to the rails 50 and intersects the generally vertical members 394.

Referring to FIG. 23B, an alternative perspective view of the embodiment of FIG. 23A is shown. The plurality of truss systems 390 has a horizontal truss system 400 that has a plurality of additional horizontal members 402 that extend between the horizontal member 396 of the generally vertical truss system 392 to both support and stiffen the rails 50 of the upper track 48 and the lower track 46. The plurality of truss systems 390 also has another, upper, horizontal truss system 410 with a plurality of horizontal members 412 that extend between the rails 50 of the upper track 48.

As best seen in FIG. 23C, the horizontal member 402 of the lower horizontal truss system 400 extends between the horizontal member 396 of the vertical truss system 392 and are above the rails 50 of the lower track 46 to provide sufficient clearance for the lower vehicle 34 shown by vertical distance 404.

Figure 24:
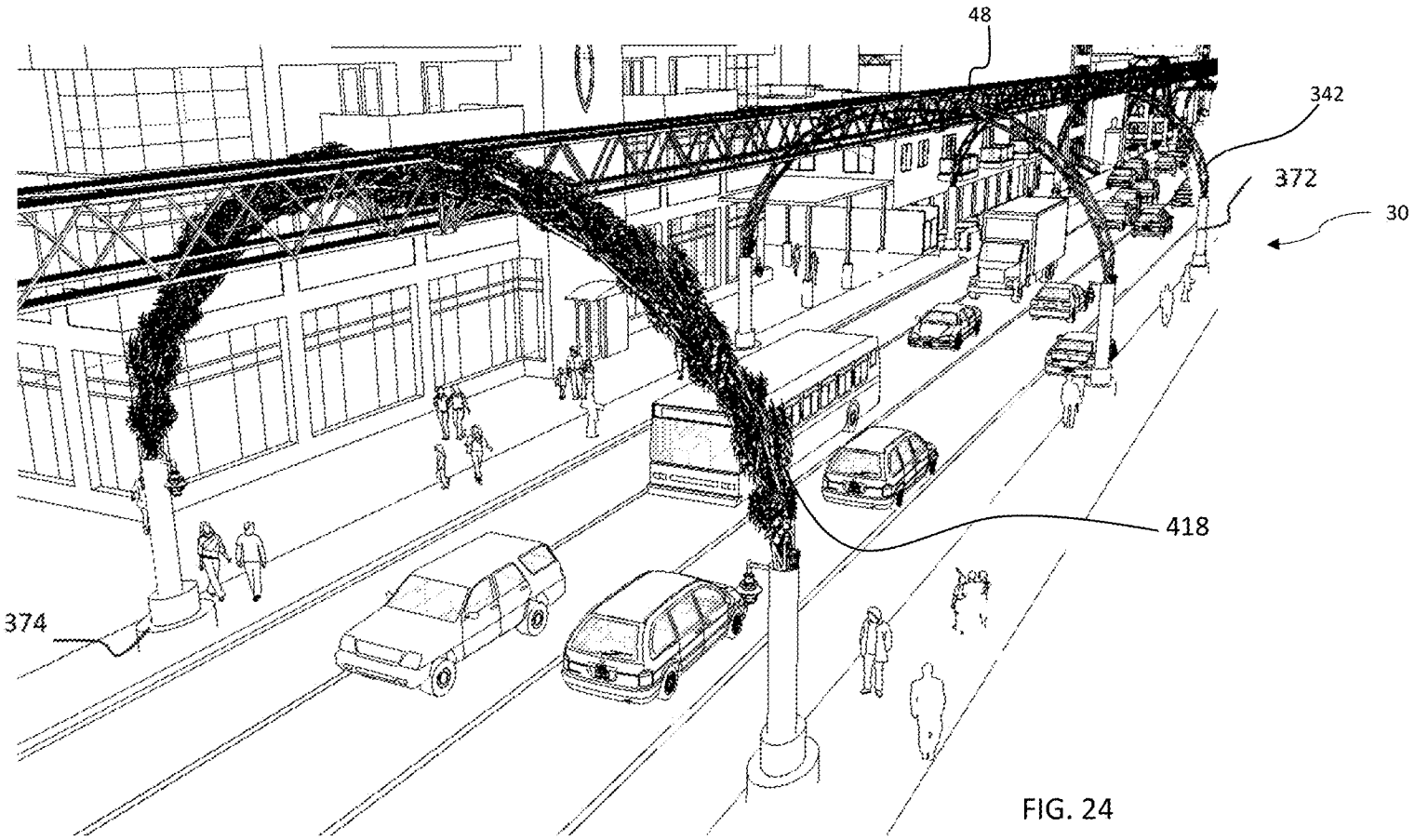
FIG. 24 is a perspective view of a portion of the transportation system having a plurality of the arches.

Referring to FIG. 24, a perspective view of the transportation system 30 having a plurality of the arches 342 supporting the upper track 48 and the lower track 46 is shown. The transportation system 30 has foliage 418 for covering the arches 342 as a way to increase ambience and introduce a more natural environment into the city landscape. The foliage 418 in certain embodiments can be real plants. In an alternative embodiment, the foliage 418 is made of non-living material such as done in certain cell phone towers.

The arch 342, in the embodiment shown, has a concrete pillar 372 around the lower portion of each leg 346 of the arch 342 to both support and protect the arch 342. The concrete pillar 372 has a pair of large annular portions 374 to improve protection of the arch 342 from accidental damage by a vehicle such as a car or truck.

Figure 25B:
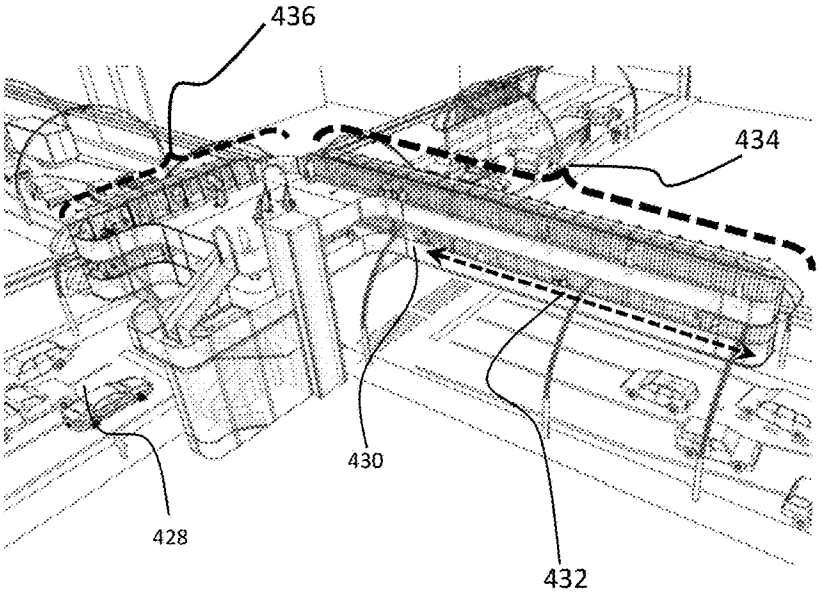
FIG. 25B is a perspective view of the train station with a longer platform.
Figure 25A:
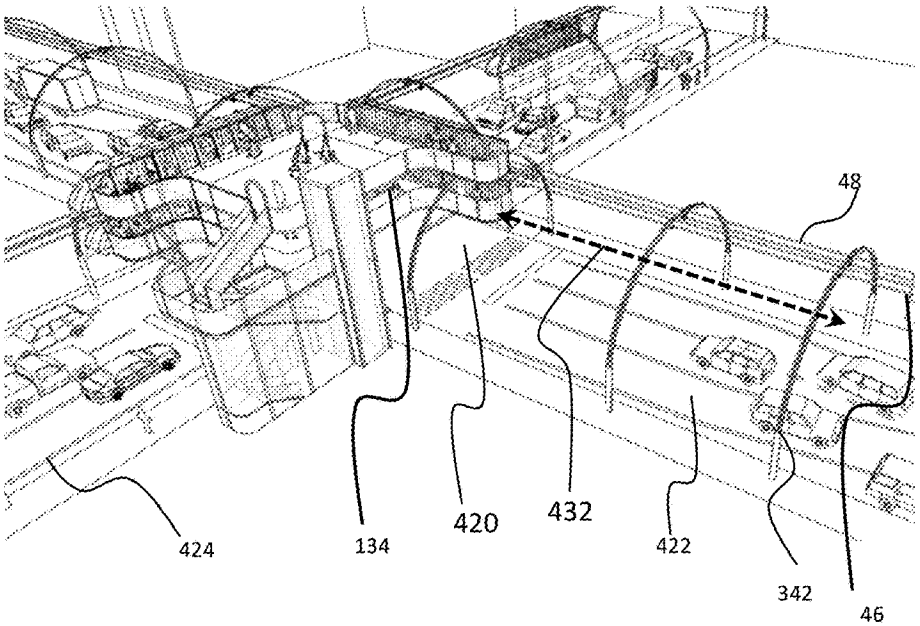
FIG. 25A is a perspective view of a train station.

Referring to FIG. 25A, a perspective view of a station 134 is shown. The station 134 shown is at an intersection 420 of a pair of streets, referred to as an east/west street 422 and a north/south street 424 for the purpose of description, in which a plurality of arches 342 span the streets 422 and 424. The arches 342 support the upper track 48 and the lower track 46.

Referring to FIG. 25B, a perspective view of the station 134 of FIG. 25A in which the portion of the station 134 over one of the streets, referred to above as the east/west street 422, has a longer platform 430 is shown. In that the station 134 is above the ground and the arches 342 are already positioned to support the upper track 48 and the lower track 46, the system 300 can have the option of having stations 134 at various capacities without requiring a different footprint on the ground surface. In both FIG. 25A and FIG. 25B, a line 432 with arrows at both ends representing the difference in distance of the platform of the shorter platform 428 in FIG. 25A and the longer platform 430 in FIG. 25B is shown.

In contrast to conventional systems, the vehicle 34 is smaller in the system 30, 300 in the embodiments described in this patent, therein the station does not need to have as large of a footprint. Likewise the tracks 46 and 48 overlay each other rather than being side by side. The station 134 including the tracks 46 and 48 for the vehicles 34 overlies only approximately a quarter of the intersection below. Therefore the system 30, 300 while above the intersection, still allows for ambient environment light in contrast to conventional elevated systems with large side by side vehicles that typically create a footprint all the way to the ground or overlay an intersection so that that the sky is not visible from the street.

In the embodiment shown in FIG. 25B, the route that follows the east/west street 422 will use longer vehicles 34 and therefore will need longer platforms 430 at the station 134. The route that follows the north/south street 424 is a smaller capacity route with a shorter vehicle 34. The difference between FIG. 25B and FIG. 25A is length defined by the distance 432 between the extended station in FIG. 25B and the shorter station in FIG. 25A. As seen in FIG. 25B between the platform for the north/south route and the east/west route the different length of the platforms between the short platform 428 and the long platform 430 allows for intersections of vehicles 34 of different capacities. Thus in FIG. 25A the longer platform marked by distance 432 is for greater capacity with longer trains shown by the bracket 434 versus the intersecting smaller capacity route with the shorter train marked by the bracket 436. It is recognized that the station 134 can be larger than the vehicle 34. For example, the shorter train, such as represented by bracket 436, can be used on the long platform 430.

Still referring to FIG. 25A and FIG. 25B, while the station does not expand or contract, the system 30, 300 lends itself to a modular system. The arches 342 can be spaced the same distance apart regardless of the size of the station. If the operator later determines that the station needs to be expanded, the operator could order modular platform components for installation. While there would be some disruption during installation, it is contemplated that no ground breaking would have to occur to make the modification. Likewise the station could be reduced in size if not required to minimize the visual impact.

INCORPORATION BY REFERENCE

The entire disclosure of each of the publications, patent documents, and other references referred to herein is incorporated herein by reference in its entirety for all purposes to the same extent as if each individual source were individually denoted as being incorporated by reference.

EQUIVALENTS

The invention may be embodied in other specific forms without departing from the spirit or essential characteristics thereof. The foregoing embodiments are therefore to be considered in all respects illustrative rather than limiting on the invention described herein. The true scope of the invention is thus indicated by the descriptions contained herein, as well as all changes that come within the meaning and ranges of equivalency thereof.

What is claimed is:

1. A transportation system comprises:

a support structure including a plurality of structure arches;

a lower track having a pair of lower rails, the lower rails supported by the support structure;

an upper track having a pair of upper rails, the upper rails spaced above the lower rails, the upper rails supported by the support structure;

a vehicle having an upper support structure with a plurality of upper wheels capable of riding on the lower track and a lower support structure with a plurality of lower wheels capable of riding on the upper track;

at least one station having a platform, wherein a floor of the vehicle is higher than the platform of the station wherein passengers are capable of entering and exiting the vehicle with less vertical movement than would be required to get up and sit down if the floor of the vehicle and station platform were at the same level; and the vehicle having an area having a floor planar with the platform of the station for facilitating access by a wheeled vehicle.

2. A transportation system of claim 1 wherein the wheeled vehicle selected from group consisting of a wheelchair and a stroller.

3. A transportation system of claim 1 wherein the vehicle has a plurality of doors and a plurality of seats wherein there is at least one door for each two seats.

4. A transportation system of claim 1 wherein the vehicle has a pair of opposing seats including a seatback portion and a seating portion, the seating portion adapted to move between a horizontal position for regular seats and a vertical position adapted to move between an area having a floor planar with the platform of the station for facilitating access by a wheeled vehicle.

5. A transportation system comprising:

a support structure including a plurality of structural arches, each of the structural arch having an apex;

a vehicle having an upper support structure with a plurality of upper wheels and a lower support with a plurality of lower wheels;

a first lower track having a pair of lower rails, the lower rails supported by the support structure;

a first upper track having a pair of upper rails, the upper rails spaced above the lower rails, the upper rails supported by the support structure;

wherein the rails of each of the tracks are located generally equidistant from the apex of each of the arches therein allowing for minimal thickness of the rails while maximizing support;

a second lower track having a pair of lower rails, the lower rails supported by the support structure, the second lower track intersecting the first lower track;

the first lower track and the second lower track each having a gap such that the rails are each spaced apart from each other;

a crossing support track having a first pair of rails underlying the first lower track and having a second pair of rails underlying the second lower track, the second pair of rails of the crossing support track intersecting the first pair of rails and adapted to engage the lower wheels of the vehicle when the vehicle passes through the gap of the lower track; and the plurality of upper wheels of the upper support structure of the vehicle are capable of riding on the lower track and the plurality of lower wheels of the lower support structure are capable of riding on the upper track, the vehicle having at least one horizontal safety wheel for engaging one of the rails of the one of the tracks associated with the lower wheels for stabilizing against derailments, wherein the arches are spaced a specific distance d that is less than the length l of the vehicle.

* * * * *